US010100411B2

(12) United States Patent
Frankiewicz et al.

(10) Patent No.: US 10,100,411 B2
(45) Date of Patent: Oct. 16, 2018

(54) SUPERNUCLEATING MULTISCALE COPPER SURFACES FOR HIGH PERFORMANCE PHASE CHANGE HEAT TRANSFER

(71) Applicant: Iowa State University Research Foundation, Inc., Ames, IA (US)

(72) Inventors: Christophe Frankiewicz, Boone, IA (US); Daniel Attinger, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 15/530,567

(22) Filed: Jan. 30, 2017

(65) Prior Publication Data

US 2017/0234628 A1 Aug. 17, 2017

Related U.S. Application Data

(60) Provisional application No. 62/388,977, filed on Feb. 12, 2016.

(51) Int. Cl.

| | |
|---|---|
| ***C23C 22/63*** | (2006.01) |
| ***C23F 1/18*** | (2006.01) |
| ***F28F 13/00*** | (2006.01) |
| ***F28F 13/18*** | (2006.01) |

(52) U.S. Cl.

CPC ..... *C23C 22/63* (2013.01); *C23F 1/18* (2013.01); *F28F 13/003* (2013.01); *F28F 13/185* (2013.01); *F28F 2245/02* (2013.01); *F28F 2245/04* (2013.01)

(58) Field of Classification Search

CPC ..... F28F 13/187; F28F 27/00; F28F 2245/02; F28F 2245/04; F28F 13/18; F28F 19/02; F28F 2245/00; C23F 1/16

USPC ..... 165/133, DIG. 510, DIG. 512, DIG. 514

See application file for complete search history.

(56) References Cited

U.S. PATENT DOCUMENTS

| | | | | |
|---|---|---|---|---|
| 3,207,209 | A | 9/1965 | Hummel | 165/1 |
| 3,301,314 | A | 1/1967 | Gaertner | 165/1 |
| 2011/0203772 | A1* | 8/2011 | Hendricks | F28F 13/185 165/104.19 |
| 2014/0037938 | A1* | 2/2014 | Li | C09D 7/1225 428/323 |

(Continued)

OTHER PUBLICATIONS

Hanglin Jo et al., A study of nucelate boiling heat transfer on hydrophilic, hydrophobic and heterogenous wetting surfaces, International Journal of Heat and Mass Transfer, 54, 5643-5652 2011.

(Continued)

*Primary Examiner* — Justin Jonaitis

(57) ABSTRACT

A method is provided for forming a biphilic surface on a substrate comprising copper, such as a heat exchanger surface, wherein the method involves forming one or more hydrophilic areas on the surface by reacting those areas with at least one of hydrogen peroxide and ammonium hydroxide to form copper oxide and forming hydrophobic areas on the surface by reacting those areas with ammonium hydroxide solution to form copper hydroxide or by chemical etching with a combination of hydrochloric acid, hydrogen peroxide, and iron chloride. The functional surface can exhibit temporal biphilicity in response to one or more stimuli in high performance heat transfer applications.

30 Claims, 12 Drawing Sheets

(56) References Cited

U.S. PATENT DOCUMENTS

2014/0150997 A1* 6/2014 Tu ..... F28D 15/046 165/104.26
2014/0336335 A1* 11/2014 Stanion ..... C08F 220/04 525/330.2
2015/0297868 A1* 10/2015 Tal ..... A61M 25/0097 604/165.02

OTHER PUBLICATIONS

Amy R. Betz et al, Do surfaces with mixed hydrophilic and hydrophobic areas enhance pool boiling?, Applied Physics Letters, 97, 141909, 2010.
M. Jakob et al, Versuche uber den Verdampfungsvorgang, Dec. 1991.
C. Frankewicz et al, Texture and wettability of metallic lotus leaves, Nanoscale, 8, 3982-3990, 2016.
Daniel Attinger et al, Surface Engineering for Phase Change Heat Transfer: A Review, MRS Energy and Sustainability, a review Journal, Sep. 2014.
Amy R. Betz et al, Boiling heat transfer on superhydrophilic, superhydrophobic, and superbiphiic surfaces, International Journal of Heat and Mass Transfer, 57, 733-741, 2013.
Jaroslaw Drelich et al, Hydrophyiliic and superhydrophillic surfaces and materials, Soft Matter, 7, 9804-9824, 2011.
S.G. Kanlikar, Controlling bubble motion over heated surface through evaporation momemtum force to enhace pool boiling heat transfer, Applied Physics Letters, 102, 051611, 2013.
Jonathan S. Coursey et al, Nanofluid boiling: The effect of surface wettability, International Journal of Heat and Fluid Flow, 29, 1577-1585, 2008.
Youngsuk Nam et al, Comparative Study of Copper Oxidation Schemes An Their Efects on Surface Wettability, Proceedings of IMECE, ASME, 2008.
Xi Yao et al, Bioinspired Ribbed Nanoneedles with Robut Superhydrophobicity, Adv. Funct. Mater., 20, 636-662, 2010.
Xiaotao Zhu et al, Facile fabrication of a superamphiphobic surface on the copper substrate, Journal of Colloid and Interface Science, 367, 443-449, 2012.
Limei Hao et al, A non-aqueous electrodeposition process for fabrication of superhydrrophobic surface with hierarchical micro/nano structure, Applied Surface Science, 8970-8973 2012.
Baitai Qian et al, Fabrication of Superhydrophobic Surfaces by Dislocation Selective Chemical Etching on Aluminum, Copper, and Zinc Substrates, Langmuir, 21, 9007-9009, 2005.
Kangjian Tang et al, Fabrication of superhydrophilic Cu2O and CuO membranes, Journal of Membrane Science, 286, 279-284 2006.
Jinping Liu et al, Hierarchical nanostructures of cupric oxide on a copper substate: controllable morphology and wettability, J. Mater. Chem, 16, 4427-4434, 2006.
Younan Xia et al, Microcontact Printing of Alkanethiols on Copper and Its Application in Micorfabrication, Chem. Mater. 8, 601-603, 1996.
Bo Chen et al, Flooded Two-Phase Flow Dynamics and Heat Transfer With Engineered Wettability on Microstructural Surfaces, Journal of Heat Transfer, 137, 091021, Sep. 2015.
C.H. Wang et al, Effect of Surface Wettability on Active Nucleation Site Density During Pool Boiling of Water on a Vertical Surface, Journal of Heat Transfer, 115, 659, Aug. 1993.
Matthew McCarthy et al, Materials, Fabrication, and , Manufacturing of Micro/Nanostructured Surfaces for Phase-Change Heat Transfer Enhancement, Nanoscale and Microscale Thermophysical Engineering, 18, 288-310, 2014.
S. Farhadi et al, Anti-icing performance of superhydrophobic surfaces, Applied Surface Science, 257, 6264-6269, 2011.
Chen Li et al, Nanostructured Copper Interfaces for Enhanced Boiling, small, 4, No. 8, 1084-1088, 2008.
Hanwei Zhang et al, Microfluidic Formation of Monodispersed Spherical Microgels Composed of Triple-Network Crosslinking, Journalof Applied Polymer Science, 121, 3093-3100, 2011.
Lianbin Xu et al, Reversible Conversion of Conducting Polymer Films from Superhydrophobic to Superhydrophilic, Angew. Chem., 44, 6009-6012, 2005.
Taolei Sun et al, Reversible Switching between Superhdrophicity and Superhydrophilicity and Superhydrophobicity, Angew. Chem., 43, 357-360, 2004.
Kirt R. Williams et al, Etch Rates for Micromachining Processing Part II, Journal of Microelectromechanical Systems, 12, No. 6, Dec. 2003.
Youngsuk Nam et al, Single bubble dynamics on a superhydrophobic surfce with artifical nucleation sites, International Journal of Heat and Mass Transfer, 54, 1572-1577, 2011.
Lin Feng et al, Petal Effect: A superhydrophobic State with High Adhesive Force, langmuir, 24, 4114-4119, 2008.
Md Mahamudar Rahman et al, Role of Wickabiloity on the Critical Heat Flux of Structured Superhydphilic Surfaces, Langmuir, 30, 11225-11234, 2014.
Tingyi Lin et al, Turing a surface superrepellent even to completely wetting, Science, 346, issue 6213, Nov. 2014.
Tom N. Krupenkin et al, From Rolling Ball to Complete Wetting: The Dynamic Tuning of Liquids on Nanostructured Surfaces, Langmuir, 20, 3824-3827, 2004.
Xi Yu et al, Reversible pH-Responsive Surface: From Superhydrophobicity to Superhydrophilicity, Adv. Mater., 17, 1289-1293, 2005.
Paul R. Jones et al, Sustaining dry surfaces under water, Scientific Reports, 5, 12311, Aug. 2015.

* cited by examiner

FIG. 1

| Texture modification (chemical solution used) | Chemical Modification (nature of the surface) | Contact angle [°] | Pool boiling enhancement compared to bare copper surface | Reference |
|---|---|---|---|---|
| Modulated porous layer coating (stack of copper microspheres) | None | Not measured | CHF (3x) HTC (2.5x) | [5] |
| Embossing | None | Not measured | CHF (2.5x) HTC (8x) | [7] |
| None | Oxidation by heat (Copper oxide) | 20 to 85 | CHF (2x) HTC (2x) | [8], [10] |
| None | Metal oxide deposition (Titanium dioxide) | 0 to 10 | CHF (2x) HTC (1.5x) | [12] |
| Microreactor Assisted Nanomaterial Deposition (Zinc oxide) | None additional (Zinc oxide) | 0 to 95 | CHF (4x) HTC (10x) | [6] |
| Chemical hydroxylation | Chemical deposition (FAS-17) | 140 to 165 | Not tested | [15] |
| (Ammonia) | | | | |
| Alkali assisted surface oxidation (sodium hydroxide and ammonium persulphate) | Fluorination (perfluorooctanoic acid) | 153 to 162 | Not tested | [16] |
| Alkali assisted electrodeposition (Potassium persulfate, Potassium hydroxide and ethanol) | Chemical deposition (FAS) | 70 to 165 | Not tested | [17] |
| Chemical Etching (Livingston's dislocation etchant) | Chemical deposition (FAS-17) | 138 to 153 | Not tested | [18] |
| Chemical Etching (Nitric acid assisted by sonication) | Chemical deposition (silanization with FDTES) | 110 to 155 | Not tested | [19] |
| Chemical Etching (Hydrochloric acid and Ferric Chloride or Hydrochloric acid and hydrogen peroxide | None | 90 to 160 | CHF (0.8x) HTC (4x) | HERE |
| Hydroxylation (Ammonium hydroxide) | None additional (Copper hydroxide / Copper oxide) | 0 to 160 | CHF (0.8x) HTC (7x) | HERE |

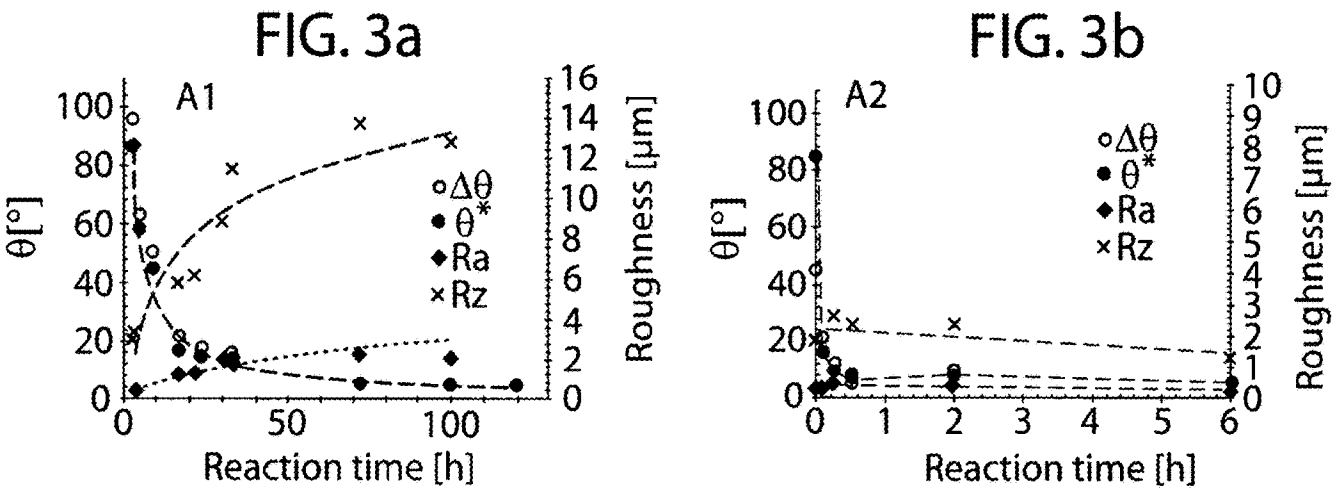
FIG. 3a
FIG. 3b
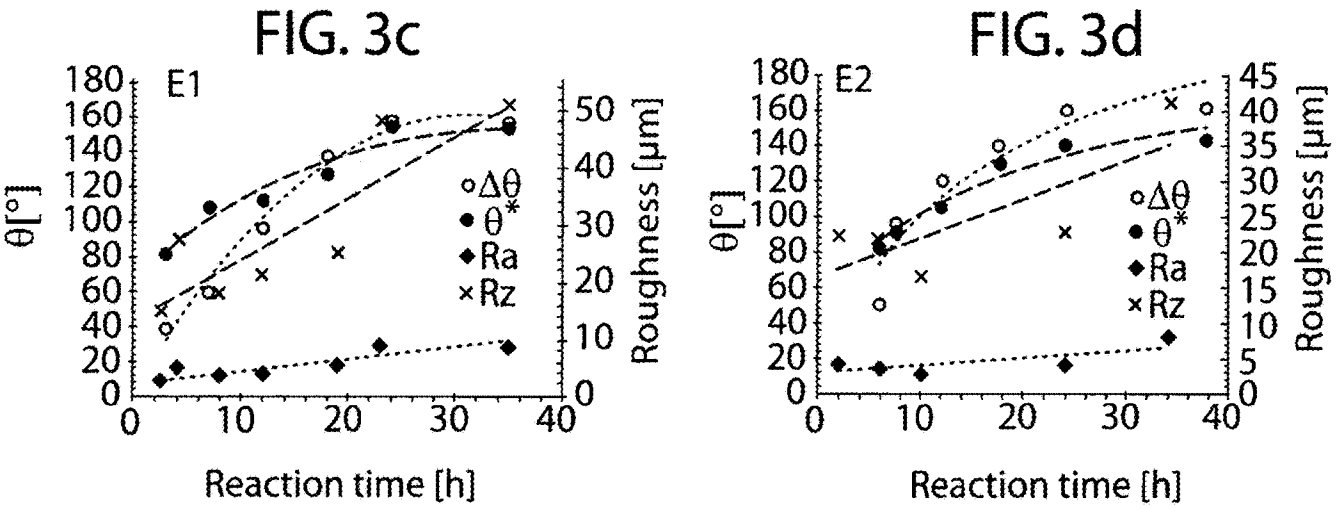
FIG. 3c
FIG. 3d

| | Surface EA | Surface E2 |
|---|---|---|
| Stimulus for the W to CB transition | Temperature 120° C / 5% humidity for 15 minutes | Temperature 120° C / 5% humidity for 15 minutes |
| Stimulus for the CB to W transition | Pressure increase to 2 bars for 30s | Pressure increase to 1.5 bars for 30s |

| | Surface EA | Surface E2 | Copper |
|---|---|---|---|
| Max. wicked Volume Flux [mm/s] (max. CHF predicted- W/cm$^2$) | ≈3.1 mm/s (≈185) | ≈2.5 mm/s (≈175) | 0 (NA) |
| Max. CHF measured [W/cm2] - wet W (Improvement compared to copper) | 174 (≈40%) | 147 (≈20%) | 123 |
| Max. CHF measured [W/cm2] - dry CB | 152 | 135 | 123 |
| HTC at ΔT= 5°C - wet W | 6.5 | 7.1 | 6.8 |
| HTC at ΔT= 5°C - dry CB (Improvement compared to copper) | 62 (≈900%) | 115 (≈1700%) | 6.8 |

FIG. 12

SUPERNUCLEATING MULTISCALE COPPER SURFACES FOR HIGH PERFORMANCE PHASE CHANGE HEAT TRANSFER

RELATED APPLICATION

This application claims benefits and priority of provisional Ser. No. 62/388,977 filed Feb. 12, 2016, the entire disclosure of which is incorporated herein by reference.

CONTRACTUAL ORIGIN OF THE INVENTION

This invention was made with government support under Grant No. CBET1235867 awarded by the National Science Foundation. The Government has certain rights in the invention.

FIELD OF THE INVENTION

The present invention relates to chemical treatment of copper surfaces to improve heat transfer for high performance phase change heat transfer, including pool boiling, and to treated copper surfaces that exhibit temporal biphilicity in response to one or more external stimuli.

BACKGROUND OF THE INVENTION

Controlling the wettability of copper surfaces is of great interest for many applications in phase change heat transfer. The wettability of surfaces has been shown to have a prominent role on the nucleate pool boiling regime. In fact, hydrophobic surfaces provide a higher number of active nucleation sites which results in higher heat transfer coefficient (HTC) [references 1, 2] whereas hydrophilic surfaces delay the onset of the so-called "critical heat flux" (CHF) [references 3, 4] that is the maximum heat flux the surface can transfer to the liquid.

The modification of both the texture and chemistry of the surface can control the wettability of liquids on the surface.

Recent developments in micro and nanotechnologies have allowed engineers and scientists to fabricate surfaces that combine microscale and nanoscale features to address the multiple length scales associated with boiling, from nucleation (O(nm)), to bubble dynamics (O(cm)). Additionally, the surface chemistry can now be controlled with high surface energy coatings such as oxides or low surface energy coating such as silanes, non-polar carbon or fluorocarbons.

Many microfabrication techniques have been implemented in heat transfer manufacturing to fabricate multiscale surfaces. Liter and Kaviany [reference 5] have designed a porous multiscale surface of superimposed copper microspheres (200 μm diameter) to form an array of conical stacks, to delay the CHF onset. Another possibility of multiscale features fabrication has been discussed in [reference 6] by using the so-called "Microreactor Assisted Nanomaterial Deposition" (MAND) process. This "flower-like" texture deposited on aluminum and silicon enhanced both the HTC (10 times higher than bare surface) and the CHF (4 times higher). Recently, embossed fins (0.5-1 mm) combined with microscale cavities at the corner of the base and floor of the fin have been shown to drastically enhance the HTC (8 times higher than a plain copper surface) and the CHF (2.5 times higher) [reference 7].

One possible technique to fabricate surfaces with a high surface energy is to oxidize the surface. Liaw and Dhir [reference 8] synthetize an oxide on top of copper surfaces by heating the copper samples in air to obtain a thin layer of copper oxide. The resulting contact angle was measured to be in the range 75°-22° and its influence in pool boiling was studied. Later, Coursey and Kim [reference 9] studied the effect of wettability in nanofluids boiling and also oxidized copper by heating a sample in air. The process of heating copper in air results in the formation of a black copper oxide (II) CuO layer also known as cupric oxide [10]. This method has been investigated or used in many studies, e.g. [reference 11]. A detailed review has been written [reference 10] on the possibility to obtain copper oxide by heating method and chemical modification. In the case of chemical modification, it has been shown that alkali solutions yield to the formation of CuO (Copper oxide (I) also known as cuprous oxide).

Takata et al. [reference 12] deposited and coated copper surfaces with $TiO_2$ layer (thickness 250 nm) to change the wettability of the surface. The same investigators also recently combined patterned biphilic surfaces on copper coated with the $TiO_2$ layer for the hydrophilic area and with Teflon hydrophobic spots (diameter equal to or greater than 2 mm) [reference 13].

To obtain surfaces with low surface energy, investigators have used chemical modification involving bonding of two (2) hydroxyls groups to form copper hydroxide [reference 14]. However, no water pool boiling studies of copper hydroxide have been carried.

Others, such as Yao et al. [reference 15], have shown a possibility to form $Cu(OH)_2$ nano needles from an ammonia solution. They reported a very high contact angles after additionally coating a FAS monolayer. A similar process to obtain microflowers was discussed in [reference 16]. Finally, a novel electro-deposition approach, based on an alkali solution, has been presented to create microstructure on an anodic copper plate [reference 17]. This method, combined with a fluoroalkasylane (FAS) monolayer coating, can result in high static contact angles (up to 165°) on copper with low hysteresis (down to 3°).

Other investigators have employed etching of the copper chemically using a solution of hydrochloric acid (HCl) and Acetic Acid also combined with a FAS coating can result in high contact angle (up to 153°), with low hysteresis (down to 10°) by modifying the surface texture randomly (etching) and the surface energy (coating) [reference 18]. Recently, etching techniques (Nitric acid assisted by cetyltrimethyl ammonium bromide and ultrasonication) combined with a silane coating were used to obtain superhydrophobicity on a randomly microstructured copper [reference 19].Finally, superhydrophobic surfaces)(CA=170°) were produced by the etching of polycristaline copper samples using etchants common in the microelectronics industry (by electrodeposition of copper films with subsequent nanowire decoration based on thermal oxidation) [reference 20].

However, the fabrication of copper biphilic surfaces for pool boiling is challenging regarding the (i) chemical stability for several superhydrophilic patterning techniques, as is the case with UV-irradiation of $TiO_2$ containing coatings which revert to their original hydrophobic state when stored [reference 25] and (ii) thermal stability for surfaces and coatings in phase change heat transfer. Additionally, micro and nanostructures may exhibit different thermal behavior compared to bulk materials [reference 26].

The possibilities to control the texture and chemistry of a surface are summarized in FIG. 1 below. On this figure, the resulting contact angles are also mentioned. The surface engineering and the contact angle references are compared to those achieved by the present invention.

Several functional surfaces able to reversibly switch their wettability have been described since the beginning of this millennium, mostly with polymeric materials. These surfaces can be classified according to the stimulus used [reference 50]. An electrically responsive surface was developed on a carboxylate-terminated self-assembled monolayer undergoing conformational transitions resulting in a reversible change of wettability properties of the surface, from a hydrophilic to a less hydrophilic wetting state (the static contact angle could be tuned in the range θ* about 25° to θ* about 45°) [reference 51]. The surface doping of a polypyrrole (PPy) conducting polymer can be controlled by applying a voltage to tune the static contact angle from θ* about 0° to θ* about 152° on the PFOS-doped (oxidized) PPy and dedoped (neutral) PPy films respectively [reference 52]. Electrowetting, an electrical stimulus, was shown to dynamically control the wetting behavior of liquids (with contact angle ranges from θ* about 180° to θ* about 0°) on a nanostructured silicon surface coated with a fluorocarbon polymer [reference 53]. A thermally responsive functional surface has been designed on a poly (N-isopropylacrylamide, i.e. PNIPAAm)-modified surface. This surface was shown to adapt its wettability from a static contact angle value θ* about 0° at a temperature T<29° C. to θ* about 149° at T>40° C. by reversible formation of intermolecular hydrogen bonds between PNIPAAm chains and water molecules [reference 54]. A thermal stimulus was also applied to a superhydrophobic surface consisting of arrays of micropillars fabricated with a liquid crystal elastomer, and resulted in the deformation of the pillars for a precise control of the wettability [reference 61]. Surfaces responsive to pH changes have also been reported [reference 55]: a monolayer containing both alkyl and carboxylic functional groups was formed on a gold-coated surface to reversibly switch from superhydrophobicity (θ* about 154°) for acid (pH 1) droplets to superhydrophilicity (θ* about 0°) for base (pH 13) droplets.

On metallic surfaces, functional wettability change has also been achieved. Photo-responsive surfaces were obtained on metal oxide materials such as $TiO_2$, ZnO, $SnO_2$ and $V_2O_5$ [references 50, 56, 57]. For instance, $V_2O_5$ nanostructured surfaces were shown to reversibly transition from a superhydrophilic wetting state (θ* about 0°) to a superhydrophobic wetting state (θ* about 160°) by exposure to UV light and maintenance in a dark storage environment, respectively [reference 56].

Applications of these surfaces to phase change heat transfer is currently very limited. The only recent example was with a silicon surface coated with gold electrodes to control boiling spatially on the scale of a few millimeters and temporally in the subsecond range [reference 58]. In this precursor work on the control of nucleation, the wettability could also be controlled with electrical pulses causing a limited variation of the contact angle from 75° to 100°. Also, the performance of silicon in pool boiling is inferior to the one of copper because of a lower thermal conductivity (1.3 W/cm·K for silicon compared to 385 W/cm·K for copper), which is a limiting factor for industrial applications. Furthermore, polymer surfaces or thin coatings might be damaged by the shear or thermal stresses [reference 42] associated with phase change heat transfer. Some functional coatings are also limited to specific applications: functional surfaces triggered by electrowetting are more suitable to act on a single, individual droplet and require the use of electrodes limiting their integration into channel configurations. The lithographic exposure required in photo-responsive materials is not convenient for industrial applications, especially at a large scale.

SUMMARY OF THE INVENTION

The present invention provides in an embodiment a method of fabrication of nanotextured surfaces on initially bare (uncoated) copper substrates with a controlled surface energy. The wettability of the surface can be selected from a hydrophobic to a hydrophilic wetting state. Practice of an embodiment of the present invention involves forming a biphilic surface with tunable wettability on a bare copper surface, wherein the biphilic surface includes or combines both hydrophobic and hydrophilic areas on the same bare copper surface.

A method embodiment of the present invention forms a biphilic surface on a substrate comprising copper, such as a heat exchanger surface, by (1) forming one or more hydrophilic areas on the surface by reacting those areas with at least one of hydrogen peroxide and ammonium hydroxide to form copper oxide and (2) forming one or more hydrophobic areas on the surface by reacting those areas with ammonium hydroxide solution to form copper hydroxide or by chemical etching with a combination of hydrochloric acid and at least one of hydrogen peroxide and ferric chloride.

In practicing illustrative embodiments of the present invention, the hydrophilic areas can be obtained by forming copper oxide, such as $Cu_2O$ or CuO, using hydrogen peroxide solution and/or ammonium hydroxide solution, and the hydrophobic areas can be obtained by forming copper hydroxide $Cu(OH)_2$ with ammonium hydroxide solution under different temperature conditions or by chemical etching with a combination of hydrochloric acid (HCl) and at least one of hydrogen peroxide ($H_2O_2$) and iron chloride ($FeCl_3$). The present invention is the first to provide superhydrophobicity on copper surfaces by an etching method without using any additional low surface energy coating.

The present invention provides a biphilic heat transfer surface useful to reach high performances in water nucleate pool boiling and other heat transfer applications wherein the surface does not lose its wettability properties with time, i.e. no aging. The multiscale textures produced by practice of the invention significantly enhance the heat transfer coefficient (HTC) compared to plain copper and the critical heat flux (CHF) in water nucleate pool boiling.

Another embodiment of the present invention involves forming a functional metallic surface, either a hydrophilic surface or a hydrophobic surface, wherein the functional surface exhibits temporal biphilicity in response to stimuli such that it can be reversibly switched between a hydrophilic state and a hydrophobic state, or vice versa. Switching of the functional surface can be effected by selected control of one or more certain stimuli (or parameters) such as including but not limited, to a pressure change, temperature change, and/or heat flux change during phase change heat transfer, such as for example pool boiling regimes that include the temporal sequence of nucleation, bubble growth, and bubble detachment (liquid-to-gas phase change).

The functional heat transfer surface is actively switchable between hydrophilic and hydrophobic states, or vice versa, to provide a high-efficiency mode suitable for low heat fluxed and a higher-power mode suitable for high heat flux applications.

The present invention also provides a fluid phase change heat transfer device having a phase change heat transfer surface comprising a metal or a metal alloy that exhibits biphillicity and a control device to control at least one of pressure and temperature to change the heat transfer surface from a hydrophobic state or a hydrophilic state, or vice versa.

Advantages and benefits of the present invention will become more readily apparent from the following detailed description taken with the following drawings.

BRIEF DESCRIPTION OF THE DRAWINGS

FIG. 1 is a table showing the manufacturing process and the contact angle ranges of engineered surfaces obtained by certain prior investigators by modifying copper surfaces where the particular references involved are listed in the right-hand column. Results of the present invention are listed in the table adjacent the right-hand column indication "HERE".

FIG. 2*a* illustrates oxidation of the copper samples by immersion in an ammonium hydroxide solution at 60° C. FIG. 2*b* illustrates oxidation of the copper samples by immersion in an alkali solution at 95° C. FIG. 2*c* illustrates chemical etching with hydrochloric acid and hydrogen peroxide. FIG. 2*d* illustrates etching of the bare copper sample with hydrochloric acid and iron chloride. FIG. 2*e* illustrates oxidation with the ammonium hydroxide solution after having etched the sample with hydrochloric acid and hydrogen peroxide. In FIGS. 2*a*-2*e*, the surfaces are named E1, E2, A1, A2 and EA in reference to the texturing method: surface resulting from an additive oxidation process is referred with the letter A, and from a subtractive wet etching with the letter E.

FIGS. 3*a*-3*d* are graphs showing the static θ* and hysteresis Δθ contact angles (C.A.), the arithmetic roughness Ra, and the height difference between the highest peak and the lowest valley Rz of roughness as a function of the reaction time. The hysteresis angle quantifies dynamic wetting, i.e. the difference between the advancing and receding contact angle. FIGS. 3*a* and 3*b* are surfaces oxidized by ammonium hydroxide and the acid/hydrogen peroxide and hydrochloric acid/iron chloride solutions, respectively.

FIG. 11 *b* depicts pool boiling curves of the functional sample surface EA in the pressure-controlled boiler.

FIG. 12 is a table that summarizes the performances obtained in the pool boiling experiments of the surface identified.

DETAILED DESCRIPTION OF THE INVENTION

Figures 2A, 2B, 2C, 2D, 2E:
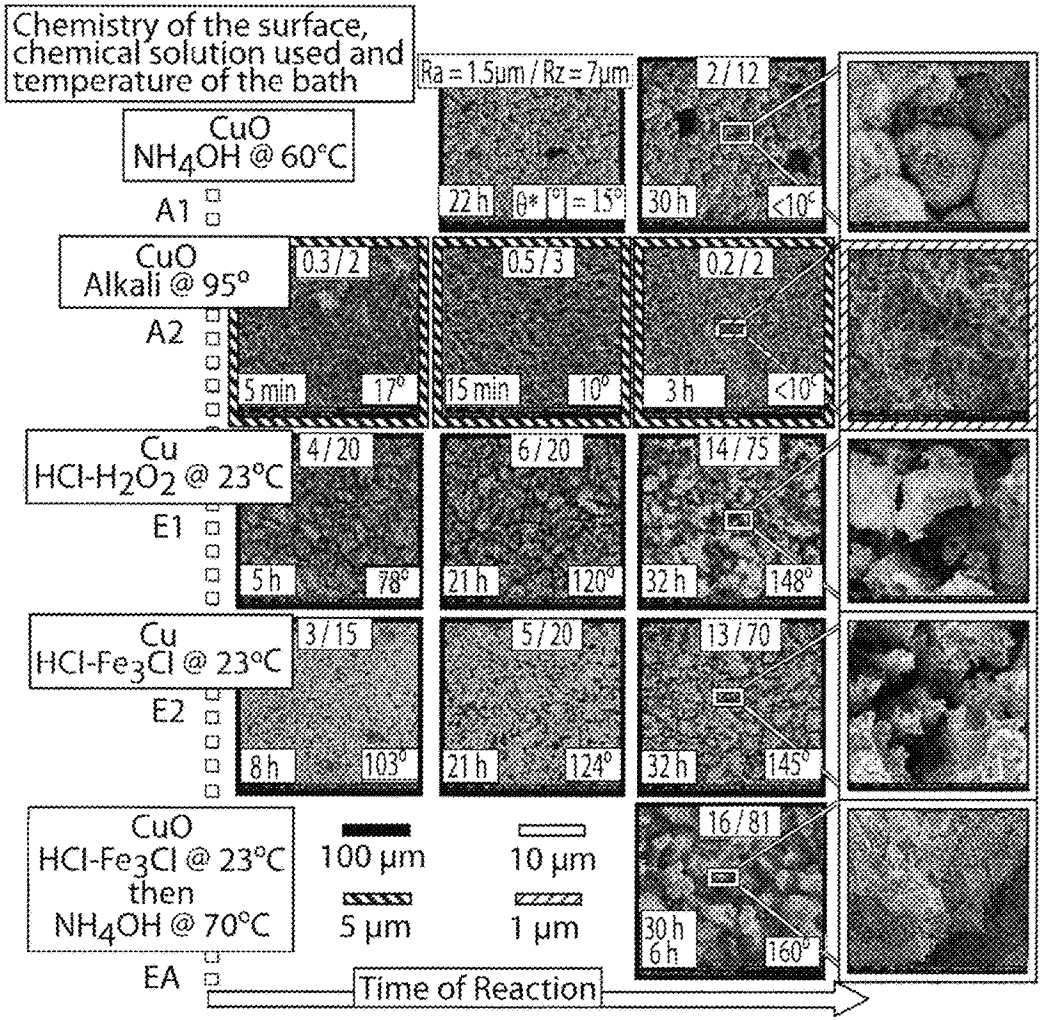
FIGS. 2*a*-2*e* show surfaces prepared pursuant to embodiment of the invention as a function of the texture modification. The roughness Ra is the arithmetic roughness and Rz the height difference between the highest peak and the lowest valley. The wetting properties in terms of static contact angles θ* are also shown for the surfaces later used in pool boiling experiments.

An embodiment of the present invention provides a method of fabricating nanotextured surfaces on initially bare (uncoated) copper substrates, such as heat exchanger surfaces, with controlled surface wettability from a superhydrophobic to superhydrophilic wetting state. Practice of an embodiment of the invention involves forming biphilic surfaces with tunable wettability on a bare (uncoated) copper surface, wherein biphilic surface includes or combines both hydrophobic and hydrophilic areas on the same copper surface. The copper substrate can include, but is not limited to, substantially pure copper or copper alloys of the type commonly used to produce heat exchangers especially for pool boiling applications.

In practice of embodiments of the present invention, the biphilic surface includes one or more hydrophilic areas on the surface formed by reacting those areas with at least one of the chemicals mentioned above (either ammonium hydroxide or an alkali solution) to form a copper oxide and one or more hydrophobic areas on the surface formed by reacting those areas with either a solution of hydrochloric acid/iron chloride or hydrochloric acid/hydrogen peroxide. The reaction times as well as the reaction temperatures can be controlled in a manner to produce different surface energy/textures to modify the contact angles (static, advancing and receding) and provide a high number of nucleation sites for heat transfer applications. Typically, a hydrophilic surface has a droplet static contact angle (θ*) of less than about 90° with superhydrophilic contact angle θ* being about 0°, and a hydrophobic surface has a static contact angle greater than about 90°, with superhydrophobic contact angle θ* being greater than about 145°.

The following examples are offered to illustrate but not limit the present invention.

EXAMPLES

The following example illustrates fabrication of multiscale surfaces and characterization of texture and wettability.

The examples employed copper samples (approx. 1×1 $cm^2$ by ⅛") (3.175 mm depth) that were polished with a 300 grit sandpaper, cleaned with isopropanol and rinsed in distilled water in a sonication water bath to remove the surface impurities. The copper samples were 99.99% copper content.

Here, the surfaces are named E1, E2, A1, A2 and EA in reference to the texturing method: surface resulting from an additive oxidation process is referred with the letter A, and from a subtractive wet etching with the letter E. Numbers 1 and 2 are used to denominate differences either in temperature or chemical solution:

- Surface A1 was prepared with ammonium hydroxide ($NH_4OH$, 28-30% wt. $NH_3$ basis in water). Copper reacts with Ammonium hydroxide $NH_4OH$ to form a dark black CuO layer at 60° C. The copper sample was directly immersed in 15 mL $NH_4OH$.
- Surface A2 was prepared by immersing the copper samples into a hot (96° C.) alkaline solution. The alkaline solution was prepared by adding 1.8 g sodium hydroxide (NaOH, reagent grade anhydrous pellets), 2.5 g sodium phosphate ($Na_3PO_4$, 96% anhydrous powder), and 5 g sodium chlorite ($NaClO_2$, technical grade anhydrous pellets) to 50 g DI water.
- Surface E1 was prepared with an etchant according to the following process: 2 mL hydrogen peroxide ($H_2O_2$, 50% wt. in water) was added to 15 mL hydrochloric acid (HCl, ACS reagent 37% titration) and stirred before adding the copper sample for microtexturing. A solution of $H_2O_2$ and HCl etches copper by the reaction: Cu (s)+2 HCl (aq)+$H_2O_2$ (aq)->$CuCl_2$ (s)+2$H_2O$.
- Surface E2 was prepared with an etchant according to the following process: a mixture of 2 g of iron chloride ($FeCl_3$, reagent grade 97%) and 15 g of HCl etch micro-textures in the copper. Iron chloride reacts with copper according to the reaction: Cu (s)+ $FeCl_3$ (aq)->CuCl (s)+$FeCl_2$ (aq). HCl was added to help decreasing the etching rate and dissolving the CuCl precipitate.
- Surface EA was first fabricated following a similar process to E2, and then submitted to an oxidation process: The concentration of $FeCl_3$ was doubled (i.e. addition of 4 g) in 15 mL HCl to reduce the anisotropy and increase the pitch of the microstructures. Also, observing that CuO surfaces (process A1) fabricated @ 60° C. had a higher roughness ratio than surfaces fabricated at 8° C., we set the temperature of reaction at 70° C., 3 degrees below the boiling point of $NH_4OH$.

By changing the reaction time as well as the reaction temperature, different textures and wettabilities can be obtained to modify the contact angles (static, advancing and receding) and provide a high number of nucleation sites.

Contact Angle (CA) Measurements:

The contact angle was measured using a goniometer to quantify the effect of the reaction time on chemical modifications of the copper surface for the chemical solutions mentioned above to produce the surface modifications shown in FIGS. 2*a*-2*e*.

Referring to FIGS. 2*a*-2*e*, surfaces are shown prepared as a function of the texture modification in terms of roughness from a bare copper sample and chemistry composition of the coating. The roughness Ra is the arithmetic roughness and Rz the height difference between the highest peak and the lowest valley. The wetting properties in terms of static contact angles θ* are also shown for the surfaces later used in pool boiling experiments.

Referring to FIGS. 3*a*-3*d*, the wettability and roughness are reported for each of the surfaces fabricated, as a function of the time in the chemical reaction bath. The static contact angle of a water drop on the surface θ* was measured as well as the hysteresis Δθ (difference between the advancing angle $\theta_A$ and receding angle $\theta_R$). Given that the receding angle is almost always equal to zero on these test surfaces, the hysteresis angle has been selected to quantify the dynamic wettability. FIGS. 3*a*-3*d* show that copper surface A1 and A2 acquired hydrophilic properties by oxidation (by oxidation and synthesis of CuO) for reaction times longer than 50 h at 60° C. (A1) and about 30 minutes at 96° C. (A2). However, superhydrophobicity properties were obtained with the HCl/$FeCl_3$ (E1) or with the HCl/$H_2O_2$ (E2) etchants for reaction times longer 30 h. Therefore, only the hysteresis contact has been plotted to relate the dynamic wettability of these surfaces.

Figure 4A:
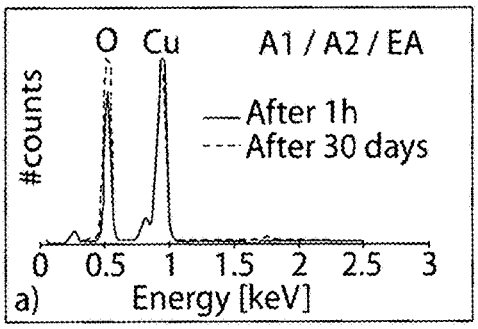
FIGS. 4*a*-4*b* show the chemical composition of the surfaces after chemical reaction. On surfaces A1, A2, and EA the main composition of the surface is copper oxide CuO. On surface E1 and E2, the surface is copper Cu. CuO has a high surface energy: a bare CuO surface would typically be hydrophilic θ*<20°. Cu has a moderate surface energy: a bare Cu surface would be moderately hydrophilic θ*≈80°.
Figure 4B:
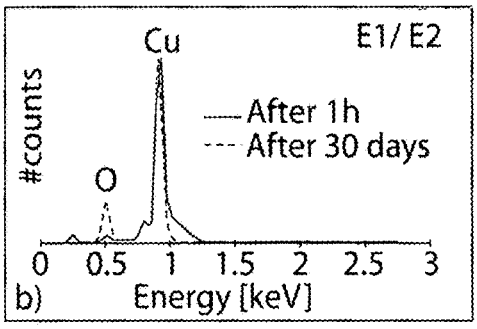

To verify the aging of the surfaces, Energy Dispersive X-ray Spectrometry (EDS) measurements were made and are reported in FIGS. 4*a*-4*b*. These measurements confirm that the superhydrophobic surfaces (in the case of E1/E2) is mainly composed of copper (Cu), and show minimal oxidation even after 30 days. Surfaces A1, A2 and EA are composed of copper oxide (CuO). The CuO coating on surfaces A1, A2 and EA is very stable even after 30 days. No de-oxidation of the top of the CuO layer with the EDS was observed.

Figure 5A:
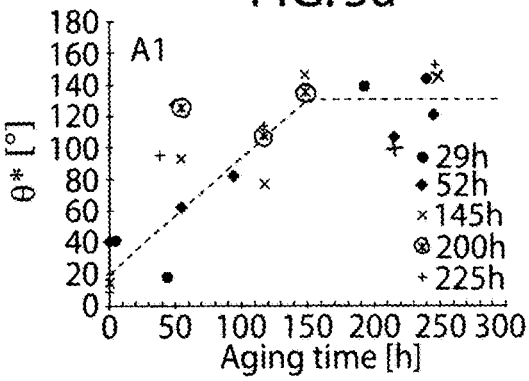
FIGS. 5*a*-5*d* show the effect of aging on the wettability of each surface. The initial aging time (t=0 second) is defined as the time that starts when the samples are rinsed after chemical reaction (i.e. microstructured).
Figure 5B:
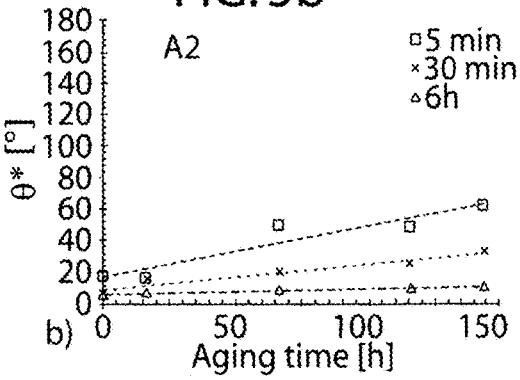
Figure 5C:
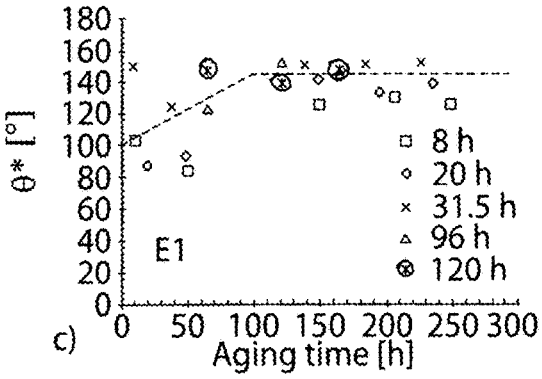
Figure 5D:
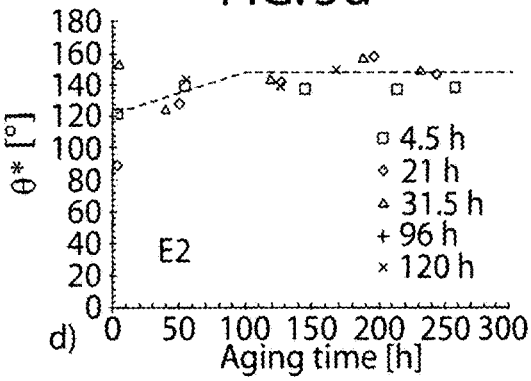

In FIGS. 5*c*-5*d*, the contact angle of the non-coated, etched Cu surfaces E1 and E2 was shown to reach a steady value (superhydrophobic) after about 50 hours. This time is probably the time required for a complete drying of the surface. In FIGS. 5*a*-5*b*, the CuO surface A1 transitions with time from superhydrophilic to hydrophobic wetting states after about 150 h. Experiments described here show that CuO surfaces are chemically stable and that the transition hydrophilic/hydrophobic is reversible and may therefore more probably due to a transition in the wetting state from a stable hydrophilic Wenzel to a metastable hydrophobic Cassie-Baxter.

Wetting of $NH_4OH$ Microstructured Surfaces:

The static contact angle of water θ* and the hysteresis angle Δθ (difference between the advancing $\theta_A$ and receding angle $\theta_R$, were measured on the solid surfaces and in ambient air using an in-house goniometer. The hysteresis was also measured by slowly controlling the volume of a spreading drop with a syringe pump (Ca<<1). The contact angles (static and dynamic) were measured at least 5 times at different locations on the surface of each sample, and averaged to the value shown on FIGS. 2*a*-2*e*, 3*a*-3*b*, and 5*a*-5*d*. The resolution of the digital images was about 3 μm per pixel for hydrophobic surfaces and 10 μm per pixel for hydrophilic ones. Post-processing was carried out with the software ImageJ. The accuracy of the contact angle measurement was ±2°.

Pool Boiling Measurements:

The pool boiling experiments served two purposes. First, the pool boiling experiments were carried out to validate the stability and durability of the surfaces in phase change heat transfer applications. Second, the wettability of surfaces strongly influences the performances in phase change heat transfer. Therefore, a study of the performances in pool boiling is particularly relevant for the potential integration of the fabrication method to large scale surfaces.

Each of the five samples in FIGS. 2*a*-2*e* were subjected to two high temperature tests: (a) In boiling water on a hot plate set at 150° C. for an hour, and (b) on a hot plate in ambient air with temperatures up to 250° C. for 10 minutes. The color, visual aspect and wetting angle values were not changed.

Figure 6:
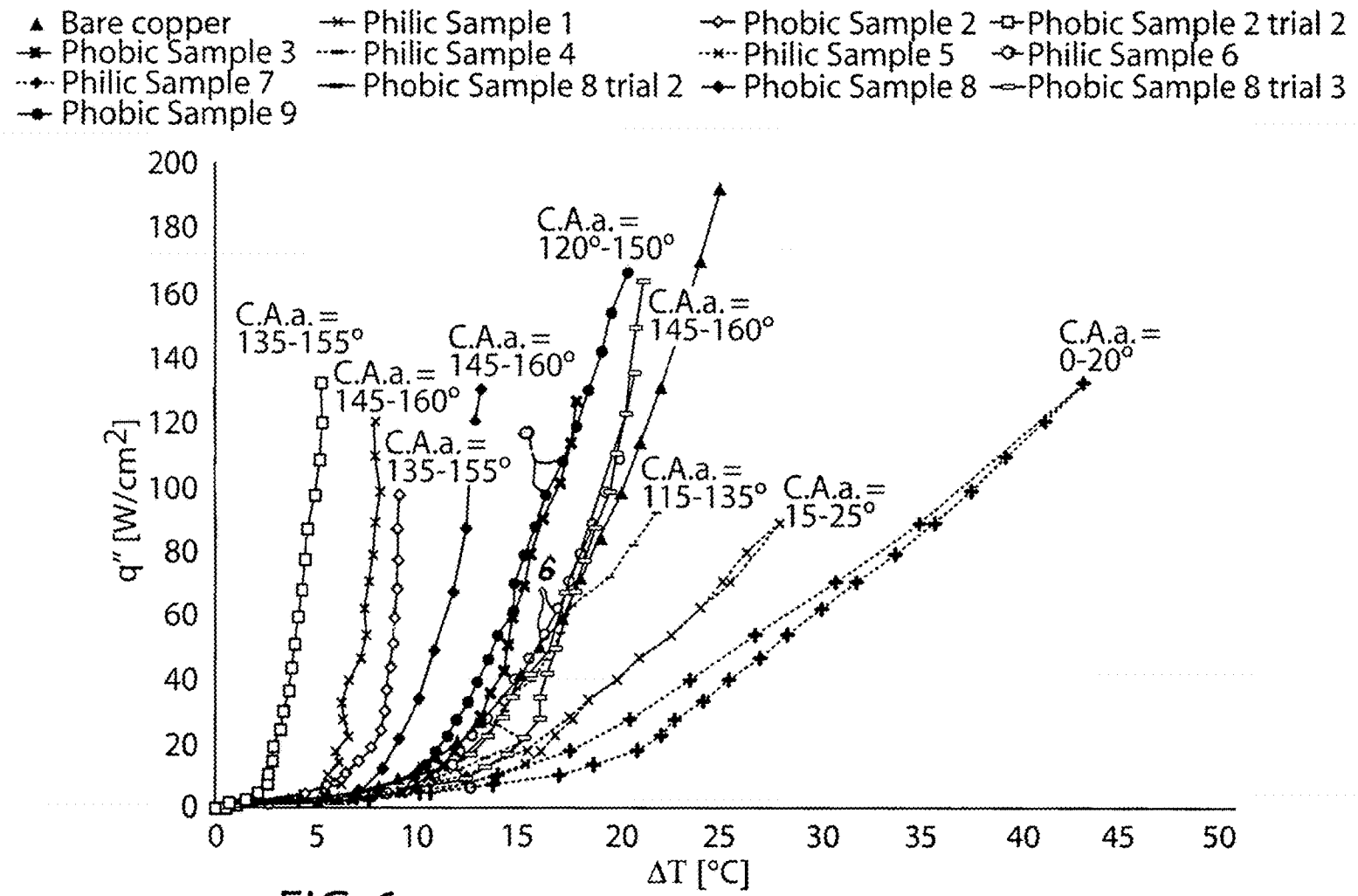
FIG. 6 shows boiling curves of the monophilic sample surfaces where q" is heat flux. Samples 1 and 3 have been fabricated using the chemical etching method ($HCl/FeCl_3$). Sample 2 has been prepared with the other etching solution ($HCl/H_2O_2$). Other samples have been fabricated using the $NH_4OH$ solution (dotted lines made with Fischer products), (plain lines made with Sigma products).

A pool boiling curve of hydrophobic and hydrophilic sample surfaces, FIG. 6, has been plotted to confirm the improved wettability obtained by practice of the invention as compared to bare copper (polished with a 600 grit sandpaper). The monophillic sample surfaces were produced by chemical reaction (immersion of the samples in a chemical bath as described above with respect to FIG. 6).

Figure 7:
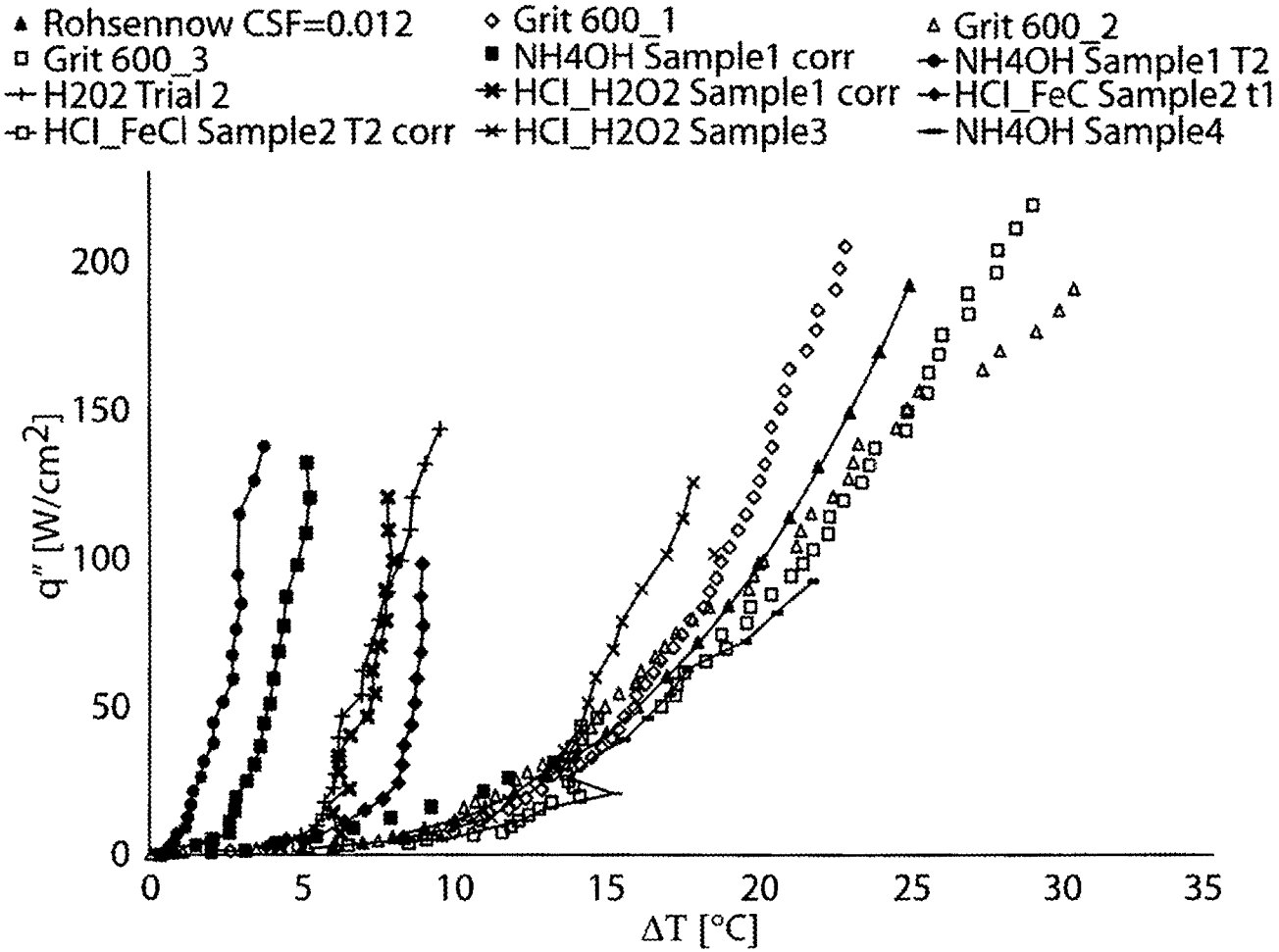
FIG. 7 shows boiling curves of the biphilic sample surfaces made by method embodiments of the invention; e.g. samples made using the chemical etching method ($HCl/FeCl_3$) and $HCl/H_2O_2$ and other samples fabricated using the $NH_4OH$ solution as indicated in the figure.

FIG. 7 contains pool boiling curves for biphilic surfaces produced as described above compared to 600 grit polished copper. The heat transfer coefficient (HTC) is approximately 2 times higher. The critical heat flux (CHF) is 0.8 times the CHF on the plain grit polished surfaces. The biphilic sample surfaces were produced using a stamping method wherein the copper samples were chemically processed similarly to the plain hydrophilic or hydrophobic samples (using the same chemical method mentioned above). However, some areas on the samples were covered using a polymer (e.g. polymethylsiloxane) that is e.g. pressed down on the surface or spin-coated on top of the surface to prevent chemical solutions to flow on the covered areas. Indeed, the polymer is chosen to be chemically resistant to the acid and base solutions used here to fabricate the samples.

FIG. 6-7 thus confirm the improved heat transfer characteristic of the copper surfaces treated as described above for the illustrative embodiments as compared to bare copper (polished with 600 grit sandpaper).

As is apparent from the above, the present invention provides a method to manufacture micro/nanotextured surfaces on copper substrates by chemical reaction between copper and the reagents described. In particular, reaction of the copper surface with ammonium hydroxide/hydrogen peroxide solutions modifies the wettability of the surface to improve hydrophobicity and hydrophilicity drastically the pool boiling performances.

The present invention is especially useful for, although not limited to, imparting improved heat transfer in heat exchangers, which are widely used in most energy-intensive industries and which collectively consume over 15 quadrillion BTU/year in the US alone. The heat transfer improvements provided by practice of the invention have the potential to generate tremendous energy savings and, in turn, energy waste and environmental pollution.

Examples of Functional Heat Transfer Surfaces Exhibiting Temporal Biphilicity

The following examples involve treated metallic surfaces that exhibit temporal biphilicity in fluid phase change heat transfer processes, such as nucleate pool boiling, which may address conflicting wettability requirements described above with respect to fluid phase change heat transfer applications that involve bubble nucleation, bubble growth, and bubble detachment from the surface. Temporal biphilicity relies on functional surfaces that can vary their wettability between hydrophilic and hydrophobic upon sequential application of one or more stimuli. These heat transfer surfaces can have enhanced hydrophobicity at low heat fluxes, to promote nucleation, and enhanced hydrophilicity at high heat flux, to promote wicking and prevent critical heat flux.

The following examples involve a method to fabricate functional robust copper surfaces that can switch from hydrophilic ($\theta^*<20°$) to superhydrophobic ($\theta^*\approx160°$), or vice versa. Also, the surfaces are free from any coating, which helps thermal and mechanical robustness. First, the fabrication of metallic surfaces that switch from hydrophilic ($\theta^*<20°$) to superhydrophobic ($\theta^*\approx160°$) will be described. Second, the transient wetting of the surface will be measured in response to either a pressure or a temperature stimulus. Third, the functional surfaces are integrated in a pool-boiling cell, and the ability to reversibly switch between a low temperature-difference mode (energy saving mode with high thermodynamic efficiency) and a high-heat flux mode.

Materials and Methods:

Surfaces Fabrication

For this example, the functional surfaces are made of copper, a material of choice for phase change heat transfer because of a thermal conductivity significantly larger (2 to 8 times) than other common metals and silicon, and two to three orders of magnitude larger than typical polymers. The copper samples were engineered into multiscale, rough surfaces following a method involving etching and additive chemistry described next.

Copper samples (101 copper alloy, 99.99% purity, approximately 10 mm×10 mm×3 mm height) were first manually polished with a 320-grit sandpaper (average particle size of 46 micrometers), to remove the native oxide layer from the surface, and cleaned with isopropanol. The samples were then sonicated in a hydrochloric acid solution (5% wt. in water) for 10 to 15 minutes, and then immersed in deionized (DI) water for another 10 minutes for cleaning and removing particles present due to polishing. The invention is not limited to high purity copper and can be practiced with copper alloyed with other metals such as, including but not limited to, titanium, nickel, and aluminum.

Then, either chemical process described below was used to modify the chemistry and texture of the copper samples.

Surface E2 was prepared with an etchant according to the following process: a mixture of 2 g of iron chloride ($FeCl_3$, reagent grade 97%) and 15 g of HCl etches micro textures in the copper. The reaction time has been selected to be about 32 h. Note that this time was found to be sufficient to generate the desired microstructure and wettability properties. More information on the effect of the reaction time on the wettability properties can be found in reference [30]. Iron chloride is a typical etchant used in the semiconductor industry for printed circuit boards; it reacts with copper according to the reaction: $Cu(s)+FeCl_3\ (aq)>CuCl\ (s)+FeCl_2\ (aq)$. HCl was added to help decrease the etch rate and dissolve the CuCl precipitate.

Surface EA was fabricated by following the process needed for E2 with an additive oxidation process, where the concentration of $FeCl_3$ in HCl was doubled to reduce the anisotropy and increase the pitch of the microstructures. The reaction time remains constant compared to the process to fabricate E2, i.e. 32 hours. A second reaction was carried in ammonium hydroxide ($NH_4OH$) at a temperature of 65° C., about three degrees below the boiling point of $NH_4OH$. Cu reacts with ammonium hydroxide ($NH_4OH$, 28-30% wt. $NH_3$ basis in water) to form a dark black CuO layer at 60° C. and a light blue $Cu(OH)_2$ layer at 8° C. The second reaction time was 48 h, which was found to be a time sufficient to obtain the desired microstructures and wettability properties. Prolonging the reaction time did not have thereafter any effect either on the wettability or on the microstructure (growth limited process).

After chemically processing the samples, the surfaces were cleaned in DI water for 15 minutes in a sonication water bath to remove potentially trapped chemicals, and then the samples were dried in air (15 seconds under compressed air, and 15 minutes at least in ambient air) before carrying out the contact angle measurements.

The above chemical processes were used repeatedly on at least four separate bare copper samples for each texturing process. The texture, chemical composition, and wettability of the surface were found to be similar for each sample, showing the repeatability of the texturing method.

Figures 8A, 8B:
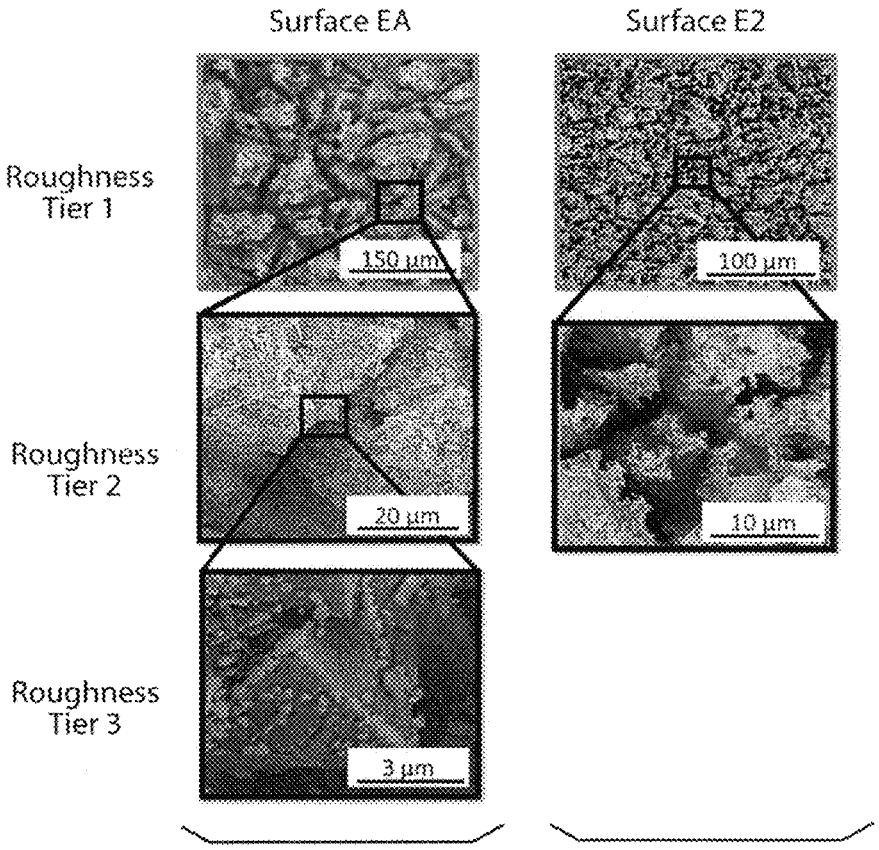
FIGS. 8*a* and 8*b* are images of surface EA and surface E2 wherein the surfaces are shown comprised of scales (tiers) of roughness (three tiers for EA and two tiers for E2), and wherein the chemistry of surface EA is CuO and chemistry of surface of E2 is Cu.

FIGS. 8*a* and 8*b* show the multiscale features obtained on each of the textured copper surfaces after fabrication, using scanning electron microscopy (SEM). SEM images of surfaces E2 (fabricated using an Etching method) and EA (fabricated using an Etching method followed by an additive oxide synthesis) show a first tier of texture consisting of pillars, with width of 50 μm. The second tier consists of micro-pillars in the case of E2, and pyramidal octahedrons in the case of EA, width (5 μm). No third tier is present in surfaces E2, while a third tier is present on EA and consists of nano-pillars, width (500 nm).

To confirm the chemical composition of the surface E2 and surface EA, an Energy-dispersive X-ray spectroscopy (EDS) analysis has been carried out a few hours after fabrication, and after 30 days. The surface of E2 is composed of copper Cu and the surface of EA of cupric oxide CuO (as suggested by both the black color of the sample and the ratio 1:1 of Cu and O elements). CuO is also the most stable oxide in hot humid conditions ($Cu_2O$ degrades itself to CuO in the presence of hot humidity).

Cu and CuO are known for being hydrophilic materials, with contact angle values ranging from 80° (bare copper) to 10° (CuO), depending on the oxidation state (the more oxidized the surface, the lower the value of the contact angle).

Contact Angle, Wettability and Roughness Measurements:

The reaction time has an effect on the chemical modification of the copper surface, contact angle, and roughness measurements. As a result, static contact angle of water $\theta^*$ and the hysteresis angle $\Delta\theta$ (difference between the advancing angle $\theta_A$ and the receding angle $\theta_R$, were measured on the solid surfaces and in ambient air using a goniometer described in reference 83, which is incorporated herein by reference. The contact angles (static and dynamic) were measured at least five times at different locations on the surface of each sample. The hysteresis was also measured by slowly controlling the volume of a spreading drop with a syringe pump ($Ca<<1$). The resolution of the digital images was about 3 μm per pixel for hydrophobic surfaces and 10 μm per pixel for hydrophilic surfaces. Post-processing of data was carried out with the software ImageJ [reference 65]. The accuracy of the contact angle measurement was ±3°.

Resistance to break-in was investigated by carrying out drop spreading and impact experiments, similarly to what has previously been reported by the inventors for lotus leaves [reference 59]. The "break-in" pressure is defined hereafter as the maximum value of the pressure that can be sustained by the surface before the liquid (here water) penetrates the roughness. This critical value of the pressure governs the reversible transition from a hydrophilic Wenzel state to a hydrophobic Cassie-Baxter state. For pressures lower than that "break-in" pressure, droplets were shown to fully bounce off of the surface, either as a whole drop or as a collection of smaller splashing droplets. Surface structures were examined with scanning electron microscopy (SEM). Note that break-in can either be partial, which results in an increase of the hysteresis angle and a decrease of the static contact angles for droplets in the metastable Cassie-Baxter state, or be complete (removing all the air between the liquid and the solid) and cause a transition to a stable Wenzel superhydrophilic state. The Cassie-Baxter state and the Wenzel state have been described previously in references 83 and 85, which are incorporated herein by reference.

Wettability Transition:

A wettability transition is useful analyzing in phase change heat transfer. Indeed, the same metallic surface with multiscale roughness can exhibit both hydrophobicity in metastable Cassie-Baxter state, where air or vapor cavities are entrapped in the multiscale roughness of the surface, and hydrophilicity when all the tiers of the surface are wetted, in a hydrophilic Wenzel state. Because of the metastable nature of the wetting state, it was possible to transition reversibly from the metastable hydrophobic CB state to a stable hydrophilic Wenzel (W) state.

Specifically, applying a liquid pressure superior to a so-called "break-in" pressure would flood the roughness, inducing a transition from the metastable CB to the hydrophilic W wetting state. Reciprocally, by removing the liquid from the flooded cavities (e.g. by drying the tiers of roughness of the surface), the surface can be reversibly switched back to the metastable CB state.

Initial Visualization of the Transitions of the Surfaces E2 and EA:

The first visualizations of the surfaces E2 and EA were obtained by immersing the surfaces in water for a long time (up to 160 minutes). Initially superhydrophobic, the surfaces EA and E2 are covered by an air layer imparting a whitish color. This air layer results from the entrapment of air inside the texture of the surface (cavities) during the submerging step inside the liquid (here, water). After 75 minutes of immersion, diffusion of the air pockets inside the bulk liquid is total for E2 and no air layer is visible on the surface. On EA, even after 160 minutes, the surface remains covered with air, which prevent the liquid from penetrating inside the roughness. Penetration of the liquid inside the roughness can be forced by increasing the value of the pressure inside a cell containing the surface. The surface EA can transition in less than 10 s (s=seconds) from the metastable CB wetting state (dried surface covered with the air layer) to the W wetting state (wetted surface) by an increase of pressure (here, the pressure was set-up to 1.5 bars).

Figure 13:
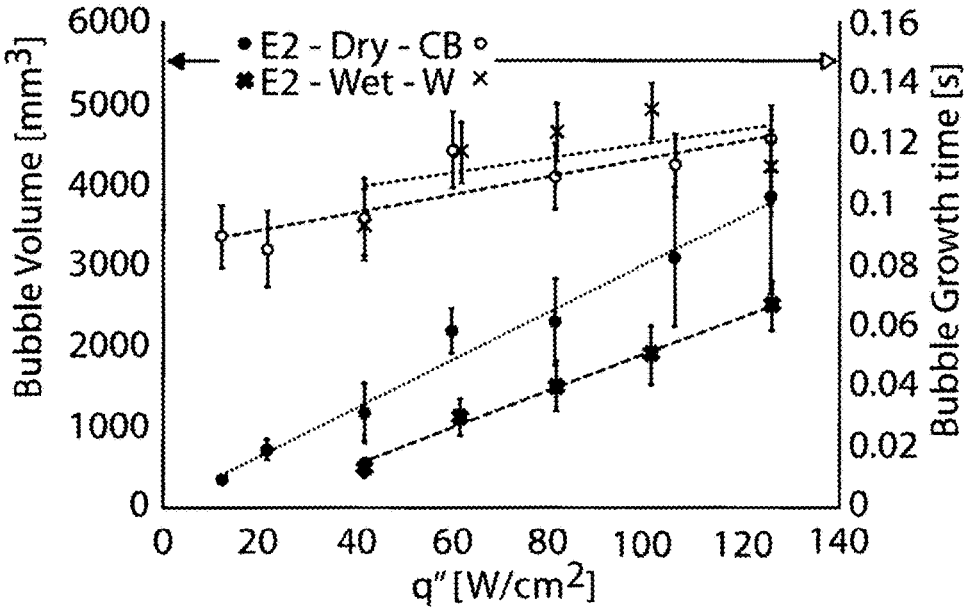
FIG. 13 shows the reversible transition in boiling of surface E2 from the metastable hydrophobic state CB to the stable hydrophilic state W.

In boiling, the transition from the hydrophilic stable W to the superhydrophobic CB state can be controlled by succinctly (pulse lasting less than 30 s) increasing the heat flux of the surface up to CHF. Reaching CHF results in the dry-out of the surface. The transition from the superhydrophobic CB to the W state can be controlled by increasing the pressure inside the boiler above the "break-in pressure", which result in the flooding of the roughness of the surface. The size (or volume) of the bubbles departing from the surface is influenced by the wetting state: for a surface in the W state, cavities are filled by liquid and are less active than cavities filled with an air/vapor pocket for a surface in the CB state, which result in smaller bubbles produced by the surface in the W state compared to the same surface in the CB state and at the same heat flux. The time of growth of the bubble to departure does not seem however to be correlated to the wetting state. FIG. 13 illustrates the reversible transition in boiling of surface E2 from the metastable hydrophobic state CB to the stable hydrophilic state W. In the superhydrophobic state, the surface E2 is almost entirely covered with a vapor layer that facilitates the nucleation process. In the hydrophilic state, surface cavities are filled with water and less active. As a result, the size of the bubbles formed on the hydrophobic surface in the CB state is larger compared to the size (or volume) of the bubbles produced on the hydrophilic surface in the W state. The time of growth of the bubble to departure from the surface does not seem to be correlated with the wetting state.

Figure 9:
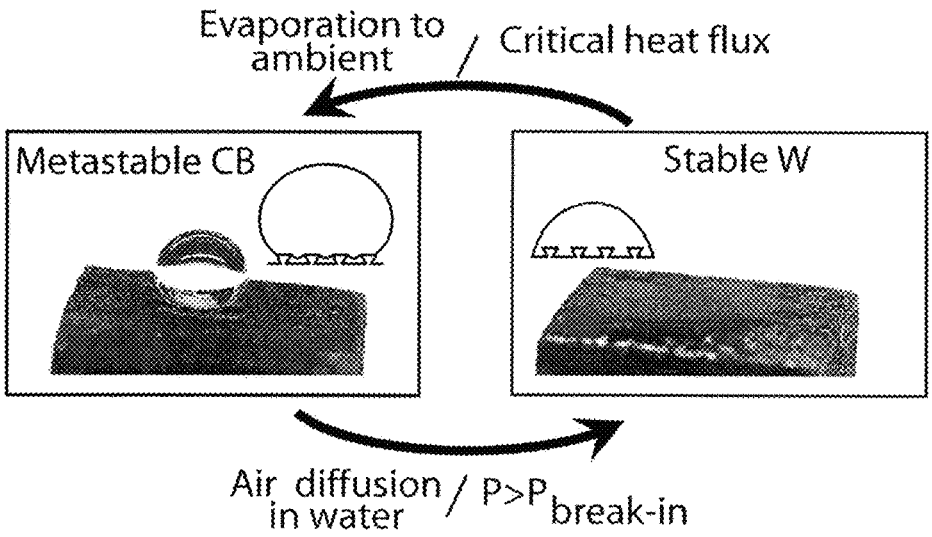
FIG. 9 schematically illustrates reversible transition of surface EA from a superhydrophobic metastable state CB to a hydrophilic stable state W.

Controlled Transitions of the Surfaces E2 and EA:

FIG. 9 illustrates controlled transition of surface EA for purposes of illustration. The surface EA can reversibly transition from a superhydrophobic metastable CB state to a hydrophobic stable W state. The stimulus triggering this transition can be reversibly controlled. For example, flooding of the cavities can be controlled by either diffusion of air inside the bulk liquid if the surface is immersed or by increasing the pressure in the liquid above the surface beyond the value of a "break-in" pressure described herein.

In particular, to controllably switch to the metastable Cassie Baxter state, two possible processes were selected and validated for surface EA as shown in FIG. 9. In air, the surface can be dried at atmospheric pressure conditions by exposure to a temperature superior to 100° C., which increases the natural vaporization rate of the liquid (here, water). When the surface is submerged under water in a pool boiling setup, a short, controlled pulse of heat flux can be generated to initiate burnout (a.k.a. Critical Heat Flux). This pulse of heat flux resulted in the vaporization of the liquid previously trapped in the tiers of roughness. The W to CB state transition is different from the Leidenfrost effect on a smooth surface in the sense that the bubbles generated remain trapped in the roughness of the sample even after the heat flux is reduced to zero.

Conversely, to switch to the hydrophilic Wenzel state, it is necessary to flood cavities at every scale of roughness. To do so, two processes were tested and validated, as shown in FIG. 9. Air pockets are always present on a wetted surface in the superhydrophobic CB state. These pockets prevent any contact between the surface and the liquid. By keeping the surface immersed in a liquid for a sufficient amount of time, these air pockets will diffuse into the bulk liquid. Another method consists in increasing the liquid pressure exerted on the air pockets contained in the cavities above the "break-in" pressure. Resistance to break-in was investigated by increasing the pressure of the reservoir (e.g. a boiling cell) in which the sample was immersed. A critical value of the pressure, called hereafter "break-in" pressure, designates the pressure level for break-in to occur. The higher the number of tiers of roughness of the functional surface, the higher the break-in pressure is.

Figure 11B:
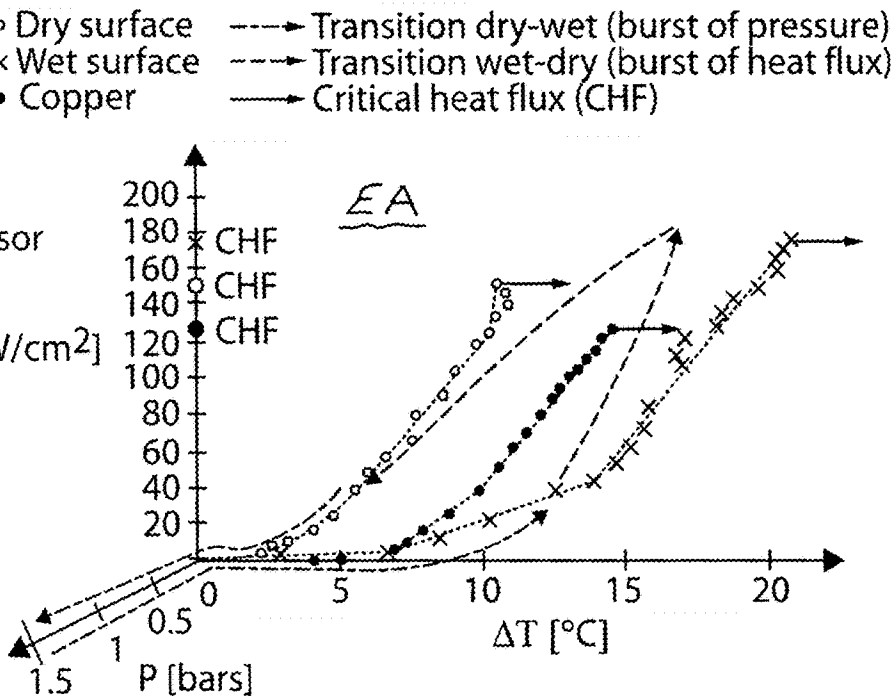
FIG. 11 *a* is a schematic of the pressure-controlled boiler.
Figure 11A:
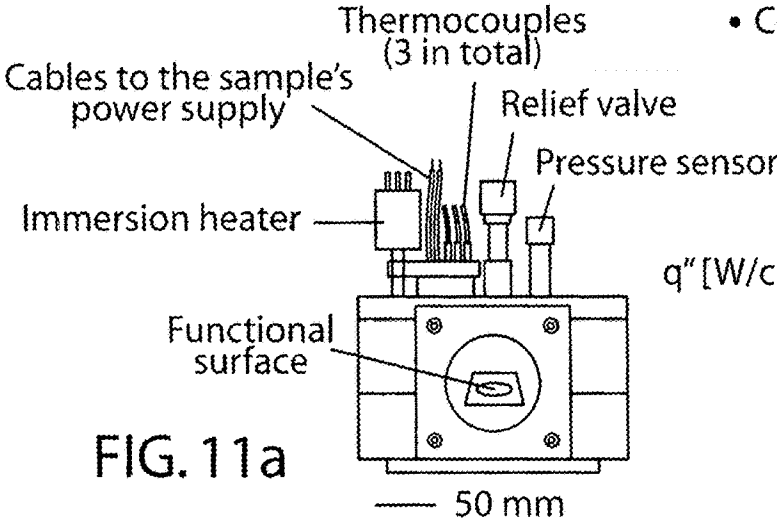

Boiling Experiments:

The boiling cell is schematically shown in FIG. 11*a*. The boiling cell was made out of stainless steel 316 to prevent corrosion. Two immersion heaters (Omega RIO-1200, 150 W each) maintained the working fluid (water) at saturation temperature. One T-type thermocouple was used to measure the saturation temperature and another one to measure the superheat temperature of the copper surface. More precisely, a T-type thermocouple was inserted in a 3 mm length, 500 microns diameter hole drilled inside the copper surface beforehand (on the trench, 1.5 mm below the surface) using a Minitech micro-milling machine Minitech 3. The thermocouples are connected to an Omega Data AcQuisition system (DAQ) OMB 54. The uncertainty on the temperature measurement by the thermocouples was ±0.4° C., as per Omega data sheet. The thermocouples were calibrated at 0° C. by using an Omega Ice Point Calibration Reference Chamber and at 100° C. by boiling DI water. The measured temperature in the middle of the surface was then used to estimate the temperature at the top of the surface using Fourier's law of conduction. A PID controller (Omega, CNi1633) controlled the operation of the immersion heaters based on thermocouple measurement of the water temperature. The pressure inside the cell was controlled by a relief valve (CDI Control model CR25-100) and measured using a piezoresistive pressure sensor (Honeywell, 19 mm Series).

To package each of the copper samples for pool boiling measurements, the following procedure was followed. A chip surface mount resistor (Component General CPR-375-1B) was soldered on the backside of the copper samples (polished beforehand with a 600 grit sandpaper). Two electric cables (32 AWG diameter) were soldered on the back of the resistor to connect the resistor to a power supply (Agilent N5750A 750W). The assembly of the thermistor and the copper engineered surface was epoxied into a Teflon holder with the sample sharp edges slightly covered with epoxy to prevent nucleation on those edges. The Type-2 deionized water was degassed beforehand by maintaining water boiling in a 1350 W microwave oven for 20 minutes. The water was then poured into the boiling cell and afterwards boiled for at least another 20 minutes with a hot plate set at 300° C. underneath the steel boiling cell, before the package was immersed and the pool boiling measurement started. By measuring the voltage and the current delivered to the heater, we obtained the heat flux delivered to the chip, assuming that all the power of the heater is transferred directly to the boiling surface, therefore neglecting the thermal losses in the Teflon block (the thermal conductivity of Teflon is only 0.25 W/m·K, to be compared with 380 W/m·K for copper).

Electrical power was then supplied for about 20 minutes to the heater to maintain a heat flux of $q''\approx 50$ W/cm$^2$ to induce nucleate boiling and degas the cavities of any air entrapped. The heat flux was subsequently decreased to 0 W/cm$^2$ and the measurement of the boiling curve was undertaken.

The high heat flux was progressively increased up to $q''\approx 60$ W/cm$^2$ by steps of $q''\approx 5$ W/cm$^2$. The heat flux was maintained for 10 minutes before each temperature measurement to ensure a constant value of the temperature and the quasi-steady state of the flow. To investigate the hysteresis of the boiling curve, the heat flux was then progressively decreased to 0 W/cm$^2$, by steps of $q''\approx 5$ W/cm$^2$. Subsequently, the heat flux was again increased at the same rate to ensure the repeatability of the measurement and obtain the value of the critical heat flux (designated CHF).

To trigger the wettability transition from the Wenzel (W) hydrophilic state (wet surface) to the Cassie-Baxter (CB) hydrophobic state (dry surface), the following procedure was followed. The heat flux was first stabilized at $q''\approx 40$ W/cm$^2$ and then a 5 s duration pulse of heat flux was sent from the power supply, controlled by the software Labview, to the thermistor ($q''\approx 180$ W/cm$^2$ for the surface EA and $q''\approx 160$ W/cm$^2$ for surface E2). The total transition time from the Wenzel hydrophilic to the Cassie-Baxter hydrophobic state was also about 5 s.

To trigger the wettability transition from the CB hydrophobic state to the W state, the heat flux was first decreased to $q''=0$ W/cm$^2$. Then a relief valve on the boiling cell was set to the desired pressure p=1.5 bars, which was reached by heating the whole cell with an external heater for approximately 15 minutes. Afterwards, the pressure in the cell was progressively decreased (within 5 minutes) to atmospheric pressure by controlling the set pressure of the relief valve. It was found that decreasing at a controlled rate the internal pressure was key to a successful CB->W transition. Possibly, the pressure and temperature conditions must be adjusted to remain at saturation conditions to prevent the initiation of boiling, which would activate the dormant cavities. Pressure and temperature conditions to activate a cavity is described in reference 30. The sample was then powered back to $q''=40$ W/cm$^2$ and the boiling curve measurement was performed following the protocol defined above (increasing or decreasing the heat flux). The total transition time from the Cassie-Baxter hydrophobic state to the Wenzel hydrophilic state was approximately 20 minutes.

Results of the Additional Experiments:

The static characterization of the wettability, its dynamic characterize; i.e., the control of wettability using pressure or temperature stimuli, and then the boiling characterization are now described.

Static Characterization of the Wettability:

The surfaces EA and E2 have a reported superhydrophibity of $\theta^* \approx 160°$ and $\theta^* \approx 150°$, respectively, in the CB state. The surface E2 was reported to have a large contact angle hysteresis ($\Delta\theta$, difference between the advancing $\theta_A$ and receding angle $\theta_R$), with $\Delta\theta \approx 150°$ ($\theta_A \approx 150°$ and $\theta_R \approx 0°$). Such large values of both $\Delta\theta$ and $\theta^*$ are typical of rose petals onto which water droplets stick.

The surface EA is water-repellent with a contact angle hysteresis smaller than 10° ($\theta_A \approx 165°$ and $\theta_R \approx 460°$), which results in roll-off of droplets deposited on the surface. Such small values of both $\Delta\theta$ and $\theta^*$ are typically reported on lotus leaves. A simple mechanistic model has been proposed to explain how multiple scales of roughness increase hydrophobicity and how three scales of roughness appear sufficient to attain super-repellency, similarly to the lotus leaves which are made of hydrophilic material and reach a metastable CB state by their multiscale roughness (reference 30). The smallest scale of roughness is shown to increase the pressure that can be sustained by the surface before it becomes wet. This pressure is called the break-in pressure.

Characterization of Wettability Transitions:

Reversible transitions between a hydrophobic Cassie-Baxter state and a hydrophilic Wenzel state have been obtained as illustrated in FIG. 9 and repeated to show reversibility.

Pressure was used as the stimulus to transition the surface from the superhydrophobic CB to the hydrophilic W wetting state. The surface was first placed in a closed reservoir containing water in which the pressure can be controlled. The pressure was increased above the break-in pressure to trigger the CB>W transition. After transition, the surface was taken out of the cell and blow-dried with a compressed-air gun for approximately 30 s to ensure that the top of the surface was dried. The static contact angle was then measured to quantify the wettability transition.

To obtain the transition from the hydrophilic W to the hydrophobic CB state, the temperature was used as a stimulus. The surface was first maintained in an environmental chamber MicroClimate® 3 from Cincinnati Sub-Zero at 120° C. and 5% relative humidity for 15 minutes. The surface was then taken out the chamber, maintained in air for 5 minutes to ensure that the surface temperature reached the steady lab temperature condition (≈25° C.). The contact angle was then measured to quantify the wettability transition.

Figure 10:
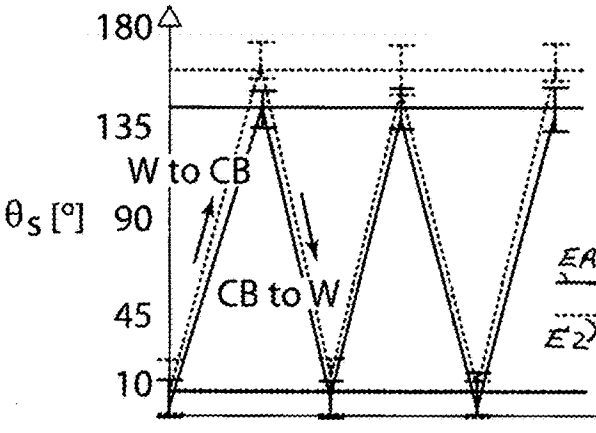
FIG. 10 depicts the reversible switching of each of surface EA and surface E2 to changes in pressure or temperature shown in the table where $\theta_s$ is the measured contact angle on the surface. The transitions from the W state to the CB state and back to the W state were triggered by a change in temperature and pressure conditions, respectively. The error bars indicate the range of contact angle was measured on the surface.

As shown in FIG. 10, the stimulus can be applied repeatedly to reversibly control the wettability of the functional surfaces EA and E2 from the W hydrophilic state to the CB superhydrophobic state. Measured wetting angle values were $\theta^* < 20°$ in the W state, and for the CB state, $160° > \theta^* > 145°$ on surface EA and $150° > \theta^* > 135°$ on surface E2. Note that the wettability transitions are fast and can be achieved in approximately 30 seconds. The transitions form the W state to the CB state and from the CB state to the W state were triggered by a change in temperature and pressure conditions, respectively. Three (3) wettability transitions cycles were performed, showing the repeatability of the experiment.

Dynamic Characterization of the Wickability:

The ability of hydrophilic surfaces to soak the liquid into the roughness is a process called imbibition or wicking. This measurement has been shown to correlate with the critical heat flux. In this example, imbibition was quantified by measuring the wicked volume flux, using a method originally developed in reference 72. In that method, the wicked volume flux into the surface Q, in m/s, is obtained by the relation $Q=(dV/dt)/A_w$, with (dV/dt) the volume flow rate inside the capillary at the time when of contact with the solid surface and $A_w$ the surface area wetted by the liquid meniscus. Values of wickability for both surfaces EA and E2 are reported in FIG. 12 in relation to the pool boiling measurements.

Wettability Switching During Boiling:

To verify the possible integration of the functional surfaces described above into industrial applications for improving phase change heat transfer performances, the surfaces were tested in the pool boiling setup described above. Boiling experiments were carried by following the procedure detailed above. Pool boiling results for surface EA show that the dry surface EA (in the CB metastable wetting state) significantly enhance the HTC at $\Delta T=5°$ C. by ≈900% compared to both a bare copper surface and to the surface in the wet W wetting state, FIG. 12. The CHF is higher by 40% on the surface EA in the W wetting state compared to both the bare copper surface and to the surface in the dry CB state, FIG. 11*b*. Similarly, an increase in HTC at $\Delta T=5°$ C. of about 1700% has been measured on surface E2, and CHF increases of 20% have been obtained on surface E2, FIG. 12. Interestingly, even the CHF of the textured superhydrophobic surface is larger than that of bare copper sample. Note that the onset of nucleate boiling is much larger on surface EA in the W state (wet surface) than on the bare copper, which is due to the higher hydrophilicity of that surface. By using these functional surfaces, the CHF can be enhanced by a factor of 1.4 and the HTC by up to 18 times compared to values of a bare copper surface.

In the above tests, the boiling curves were repeated two to three times and showed a remarkable consistency in the results. This consistency also suggests that the functional surfaces are durable and that the microstructures are not damaged by the sudden pressure and heat flux change.

The CHF is correlated to the ability of the surface to wick. The wicked volume flux was obtained by measuring the initial velocity of the meniscus inside the capillary tube (external diameter 500 μm) and the wetted area $A_w$. The surfaces EA and E2 reached a CHF close to the maximum value of the critical heat flux predicted by the value of the wicked volume flux.

The wicked volume flux was shown to be highly correlated to the performance of the surface in pool boiling in terms of CHF. The relation between the maximum CHF as a function of the value of the wicked volume flux showed that the higher the wicked volume flux, the higher the CHF. The measured CHF and the CHF estimated from wickability measurements were found to be close, as shown in the table of FIG. 12.

While the W to CB transition is simply obtained by a burst of heat, the CB to W transition is obtained by a more cumbersome control of the pressure. Possibly, other physical processes can be implemented to favor the CB-W transition, involving e.g. chemical dissolution or acoustic waves. Nevertheless, the examples described above demonstrate that temporal biphilicity can enhance phase change heat transfer using robust metallic surfaces without coating (in contrast to other surfaces exhibiting functional change of wettability, which are mostly based on polymeric materials) and opens the door to use of temporal biphilicity, which is one of the characteristics of an ideal surface for phase change heat transfer, such as nucleate boiling.

The above additional examples demonstrate that two functional surfaces, EA E2 which were fabricated, are shown to repeatedly and reversibly adapt their wettability in response to a stimulus in situ from a hydrophilic ($\theta^*<20°$) to a superhydrophobic wetting state ($\theta^*>145°$). The surface wettability is controlled from a metastable superhydrophobic Cassie-Baxter to a stable hydrophilic Wenzel state by trapping or vaporizing liquid inside the tiers of roughness of the surface. To demonstrate the potential integration of the functional surfaces pursuant to the invention in industrial applications, it has been shown in a pool boiling process that the wetting state of the surface can be dynamically controlled to adapt the power performances as a function of the application needs. While the metastable Cassie-Baxter offers high thermodynamic efficiency with up to 1700% improvements in heat transfer coefficient compared to a bare copper surface at a representative superheat of 5K, the hydrophilic Wenzel state increases the critical heat flux by up to 40% compared to a bare copper surface.

NOMENCLATURE USED IN EXAMPLES OF FUNCTIONAL HEAT TRANSFER SURFACES EXHIBITING TEMPORAL BIPHILICITY $\theta^*$ Equilibrium contact angle on the engineered surface
$\Delta\theta$ Contact angle hysteresis
$\theta_A$ Advancing contact angle
$\theta_R$ Receding contact angle
T Temperature in ° C.
q" Heat flux in $W/m^2$
$\Delta T$ Superheat temperature in ° C.
P Pressure, Pa
V Volume of the liquid inside the capillary tube, $m^3$
Q Wicked volume flux, $m^3/s$
$A_w$ Surface area wetted by the liquid meniscus, $m^2$

ACRONYMS

CB Cassie-Baxter
W Wenzel
HTC Heat transfer coefficient
CHF Critical heat flux
EA, E2 two types of multiscale copper surface, based on (E)tching and/or (A)dditive chemistry

REFERENCES, WHICH ARE INCORPORATED HEREIN BY REFERENCE

[1] R. D. Narhe and D. A. Beysens, "Nucleation and growth on a superhydrophobic grooved surface," Physical Review Letters, vol. 93, Aug. 13 2004.

[2] A. R. Betz, J. Jenkins, C.-J. C. J. Kim, and D. Attinger, "Boiling heat transfer on superhydrophilic, superhydrophobic, and superbiphilic surfaces," International Journal of Heat and Mass Transfer, vol. 57, pp. 733-741, February 2013.

[3] J. Drelich, E. Chibowski, D. D. Meng, and K. Terpilowski, "Hydrophilic and superhydrophilic surfaces and materials," Soft Matter, vol. 7, p. 9804, 2011.

[4] H. Jo, H. S. Ahn, S. Kang, and M. H. Kim, "A study of nucleate boiling heat transfer on hydrophilic, hydrophobic and heterogeneous wetting surfaces," International Journal of Heat and Mass Transfer, vol. 54, pp. 5643-5652, 2011.

[5] S. G. Liter and M. Kaviany, "Pool boiling CHF enhancement by modulated porous layer coating: theory and experiment," International Journal of Heat and Mass Transfer, vol. 44, pp. 4287-4311, 2001.

[6] T. J. Hendricks, S. Krishnan, C. Choi, C.-H. Chang, and B. Paul, "Enhancement of pool-boiling heat transfer using nanostructured surfaces on aluminum and copper," International Journal of Heat and Mass Transfer, vol. 53, pp. 3357-3365, 2010.

[7] S. G. Kandlikar, "Controlling bubble motion over heated surface through evaporation momentum force to enhance pool boiling heat transfer," Applied Physics letters, vol. 102, p. 051611, 2013.

[8] S. P. Liaw and V. K. Dhir, "Effect of surface wettability on transition boiling heat transfer from a vertical surface," in Proceedings of the Eighth International Heat Transfer Conference, San Francisco, Calif., 1986, pp. 2031-2036.

[9] J. S. Coursey and J. Kim, "Nanofluid boiling: The effect of surface wettability," International Journal of heat and fluid flow, vol. 29, pp. 1577-1585, 2008.

[10] Y. Nam and Y. Sungtaek Ju, "Comparative study of copper oxidation schemes and their effects on surface wettability," presented at the Proceedings of IMECE, Boston, Mass., USA, 2008.

[11] A. E. Bergles and W. G. Thompson Jr, "The relationship of Quench data to steady-state pool boiling data," International Journal of Heat and Mass Transfer, vol. 13, pp. 55-68, 1970.

[12] Y. Takata, S. Hidaka, J. M. Cao, T. Nakamura, H. Yamamoto, M. Masuda, and T. Ito, "Effect of surface wettability on boiling and evaporation," Energy, vol. 30, pp. 209-220, February-March 2005.

[13] B. J. Suroto, M. Tashiro, S. Hirabayashi, S. Hidaka, M. Kohno, and Y. Takata, "Effects of Hydrophobic-Spot Periphery and Subcooling on Nucleate Pool Boiling from a Mixed-Wettability Surface," Journal of Thermal Science and Technology, vol. 8, pp. 294-308, 2013.

[14] P. Patnaik, Handbook of Inorganic Chemicals. United States of America: McGraw-Hill, 2002.

[15] X. Yao, Q. Chen, L. Xu, Q. Li, Y. Song, X. Gao, D. Quere, and L. Jiang, "Bioinspired Ribbed Nanoneedles with Robust Superhydrophobicity," Advanced functional materials, vol. 20, pp. 656-662, 2010.

[16] X. Zhu, Z. Zhang, X. Xu, X. Men, J. Yang, X. Zhou, and Q. Xue, "Facile fabrication of a superamphiphobic surface on the copper substrate," J Colloid Interface Sci, vol. 367, pp. 443-9, Feb. 1 2012.

[17] L. Hao, Z. Chen, R. Wang, C. Guo, P. Zhang, and S. Pang, "A non-aqueous electrodeposition process for fabrication of superhydrophobic surface with hierarchical micro/nano structure," Applied Surface Science, vol. 258, pp. 8970-8973, 2012.

[18] B. Qian and Z. Shen, "Fabrication of Superhydrophobic Surfaces by Dislocation-Selective Chemical Etching on Aluminum, Copper and Zinc Substrates," Langmuir, vol. 21, pp. 9007-9009, 2005.

[19] L. Pan, H. Dong, and P. Bi, "Facile preparation of superhydrophobic copper surface by HN03 etching technique with the assistance of CTAB and ultrasonication," Applied Surface Science, vol. 257, pp. 17071711, 2010.

[20] F. Mumm, A. T. J. Van Helvoort, and P. Sikorski, "Easy Route to Superhydrophobic Copper-Based WireGuided Droplet Microfluidic Systems," Acs Nano, vol. 3, 2009.

[21] V. K. Dhir and S. P. Liaw, "Framework for a Unified Model for Nucleate and transition Pool Boiling," Journal of Heat Transfer, vol. 111, pp. 739-746, 1989.

[22] K. Tang, X. Wang, W. Yan, J. Yu, and R. Xu, "Fabrication of superhydrophilic $Cu_2O$ and CuO membranes," Journal of Membrane Science, vol. 286, pp. 279-284, 2006.

[23] J. Liu, X. Huang, Y. Li, K. M. Sulieman, X. He, and F. Sun, "Hierarchical nanostructures of cupric oxide on a copper substrate: controllable morphology and wettability," Journal of Materials Chemistry, vol. 16, p. 4427, 2006.

[24] Y. Takata, S. Hidaka, and T. Uraguchi, "Boiling Feature on a Super Water-Repellent Surface," Heat Transfer Engineering, vol. 27, pp. 25-30, 2006.

[25] X. Zhang, H. Kono, Z. Liu, S. Nishimoto, D. A. Tryk, T. Murakami, H. Sakai, M. Abe, and A. Fujishima, "A transparent and photo-patternable superhydrophobic film, " Chemical Communications, pp. 4949-4951, Dec. 14 2007.

[26] M. Zhang, M. Y. Efremov, F. Schiettekatte, E. A. Olson, A. T. Kwan, S. L. Lai, T. Wisleder, J. E. Greene, and L. H. Allen, "Size-dependent melting point depression of nanostructures:Nanocalorimetric measurements," Physical Review B, vol. 62, pp. 10548-10557, 2000.

[27] M. B. Yim, P. B. Chock, and E. R. Stadtman, "Copper, Zinc superoxide dismutase catalyzes hydroxyl radical production for hydrogen peroxide," Proceedings of the National Academy of Sciences of the United States of America, vol. 87, pp. 5006-5010, 1990.

[28] Y. Xia, E. Kim, M. Mrksich, and G. M. Whitesides, "Microcontact Printing of Alkanethiols on Copper and its application in microfabrication," Chem. Mater., vol. 8, pp. 601-603, 1996.

[29] Gil, E., and Hudson, S., 2004, "Stimuli-reponsive polymers and their bioconjugates," Progress in Polymer Science, 29(12), pp. 1173-1222.

[30] Daniel, S., Chaudhury, M. K., and Chen, J. C., 2001, "Fast Drop Movements Resulting from the Phase Change on a Gradient Surface," Science, 291(5504), pp. 633-636.

[31] Ghosh, A., Ganguly, R., Schutzius, T. M., and Megaridis, C. M., 2014, "Wettability patterning for high-rate, pumpless fluid transport on open, non-planar microfluidic platforms," Lab Chip, 14(9), pp. 1538-1550.

[32] Thevenin, R., Wu, L. Z., Keller, P., Cohen, R. E., Clanet, C., and Quere, D., "New thermal-sensitive superhydrophobic material," Proc. APS-DFD 2013, A. P. Society, ed.

[33] Chen, B., Zhou, Z., Shi, J. X., Schafer, S. R., and Chen, C. L., 2015, "Flooded Two-Phase Flow Dynamics and Heat Transfer With Engineered Wettability on Microstructured Surfaces," Journal of Heat Transfer-Transactions of the Asme, 137(9).

[34] Ji, Y. L., Li, G., Sun, Y. Q., and Ma, H. B., 2015, "Wettability Control of VACNT Array through Atmospheric Plasma Treatment," Journal of Heat Transfer-Transactions of the Asme, 137(2).

[35] Liu, L., and Jacobi, A. M., 2009, "Air-Side Surface Wettability Effects on the Performance of Slit-Fin-and-Tube Heat Exchangers Operating Under Wet-Surface Conditions," Journal of Heat Transfer-Transactions of the Asme, 131(5).

[36] Son, S. Y., and Allen, J. S., 2004, "Visualization of wettability effects on mcirochannel two-phase flow resistance," Journal of Heat Transfer-Transactions of the Asme, 126(4), pp. 498-498.

[37] Wang, C. H., and Dhir, V. K., 1993, "Effect of surface wettability on active nucleation site density during pool boiling of water on a vertical surface," Journal of Heat Transfer-Transactions of the ASME, 115(3), pp. 659-669.

[38] Peles, Y., and Wang, E. N., 2014, "Preface," Nanoscale and Microscale Thermophysical Engineering, 18(3), pp. 195-196.

[39] McCarthy, M., Gerasopoulos, K., Maroo, S. C., and Hart, A. J., 2014, "Materials, Fabrication, and Manufacturing of Micro/Nanostructured Surfaces for Phase-Change Heat Transfer Enhancement," Nanoscale and Microscale Thermophysical Engineering, 18(3), pp. 288-310.

[40] Attinger, D., Frankiewicz, C., Betz, A. R., Schutzius, T. M., Ganguly, R., Das, A., Kim, C. J., and Megaridis, C. M., 2014, "Surface Engineering for Phase Change Heat Transfer: A Review," MRS Energy & Sustainability, 1, p. E4.

[41] Das, S., and Mitra, S. K., 2013, "Different regimes in vertical capillary filling," Physical Review E, 87(6), p. 063005.

[42] Farhadi, S., Farzaneh, M., and Kulinich, S. A., 2011, "Anti-icing performance of superhydrophobic surfaces," Applied Surface Science, 257(14), pp. 6264-6269.

[43] Derby, M. M., Chatterjee, A., Peles, Y., and Jensen, M. K., 2014, "Flow condensation heat transfer enhancement in a mini-channel with hydrophobic and hydrophilic patterns," International Journal of Heat and Mass Transfer, 68, pp. 151-160.

[44] Li, C., Wang, Z., Wang, P.-I., Peles, Y., Koratkar, N., and Peterson, G. P., 2008, "Nanostructured copper interfaces for enhanced boiling," Small, 4(8), pp. 1084-1088.

[45] Betz, A. R., Zhang, H., Chen, W., and Attinger, D., 2010, "Microfluidic Formation of Monodispersed Spherical Microgels Composed of Triple-network Crosslinking," ASME International Conference on Nanochannels, Microchannels, and MinichannelsMontreal, Canada.

[46] Betz, A. R., Jenkins, J., Kim, C.-J., and Attinger, D., 2013, "Boiling heat transfer on superhydrophilic, superhydrophobic, and superbiphilic surfaces," International Journal of Heat and Mass Transfer, 57(2), pp. 733-741.

[47] Van Dyke, A. S., Collard, D., Derby, M. M., and Betz, A. R., 2015, "Droplet coalescence and freezing on hydrophilic, hydrophobic, and biphilic surfaces," Applied Physics letters, 107(14), p. 141602.

[48] Fazeli, A., Mortazavi, M., and Moghaddam, S., 2015, "Hierarchical biphilic micro/nanostructures for a new generation phase-change heat sink," Applied Thermal Engineering, 78, pp. 380-386.

[49] Xia, F., Zhu, Y., Feng, L., and Jiang, L., 2009, "Smart responsive surfaces switching reversibly between superhydrophobicity and super-hydrophilicity," Soft Matter, 5(2), pp. 275-281.

[50] Lahann, J., Mitragotri, S., Tran, T.-N., Kaido, H., Sundaram, J., Choi, I. S., Hoffer, S., Somorjai, G. A., and Langer, R., 2003, "A Reversibly Switching Surface," Science, 299(5605), pp. 371-374.

[51] Xu, L., Chen, W., Mulchandani, A., and Yan, Y., 2005, "Reversible conversion of conducting polymer films from superhydrophobic to superhydrophilic," Angew Chem Int Ed Engl, 44(37), pp. 6009-6012.

[52] Krupenkin, T. N., Taylor, J. A., Schneider, T. M., and Yang, S., 2004, "From Rolling Ball to Complete Wetting: The Dynamic Tuning of Liquids on Nanostructured Surfaces," Langmuir, 20(10), pp. 3824-3827.

[53] Sun, T., Wang, G., Feng, L., Liu, B., Ma, Y., Jiang, L., and Zhu, D., 2004, "Reversible switching between superhydrophilicity and superhydrophobicity," Angew Chem Int Ed Engl, 43(3), pp. 357-360.

[54] Yu, X., Wang, Z., Jiang, Y., Shi, F., and Zhang, X., 2005, "Reversible pH-Responsive Surface: From Superhydrophobicity to Superhydrophilicity," Advanced Materials, 17(10), pp. 1289-1293.

[55] Lim, H. S., Kwak, D., Lee, D. Y., Lee, S. G., and Cho, K., 2007, "UV-Driven Reversible Switching of a Roselike Vanadium Oxide Film between Superhydrophobicity and Superhydrophilicity," Journal of the American Chemical Society, 129(14), pp. 4128-4129.

[56] Lai, Y., Lin, C., Wang, H., Huang, J., Zhuang, H., and Sun, L., 2008, "Superhydrophilic-superhydrophobic micropattern on TiO2 nanotube films by photocatalytic lithography," Electrochemistry Communications, 10(3), pp. 387-391.

[57] Cho, H. J., Mizerak, J. P., and Wang, E. N., 2015, "Turning bubbles on and off during boiling using charged surfactants," Nature communications, 6, p. 8599.

[58] Frankiewicz, C., and Attinger, D., 2015, "Texture and wettability of metallic lotus leaves," Nanoscale, 6, pp. 3982-3990.

[59] Williams, K. R., Gupta, K., and Wasilik, M., 2003, "Etch rates for micromachining processing-Part II," Journal od Microelectromechanical Systems, 12(6), pp. 761-778.

[60] Yao, X., Chen, Q., Xu, L., Li, Q., Song, Y., Gao, X., Quéré, D., and Jiang, L., 2010, "Bioinspired Ribbed Nanoneedles with Robust Superhydrophobicity," Advanced functional materials, 20(4), pp. 656-662.

[61] Wang, S.-B., Hsiao, C.-H., Chang, S.-J., Lam, K.-T., Wen, K.-H., Young, S.-J., Hung, S.-C., and Huang, B.-R., 2012, "CuO nanowire-based humidity sensor," Sensors Journal, IEEE, 12(6), pp. 1884-1888.

[62] Nam, Y., Aktinol, E., Dhir, V. K., and Ju, Y. S., 2011, "Single bubble dynamics on a superhydrophilic surface with artificial nucleation sites," International Journal of Heat and Mass Transfer, 54(7-8), pp. 1572-1577.

[63] Liaw, S. P., and Dhir, V. K., "Effect of surface wettability on transition boiling heat transfer from a vertical surface," Proc. Proceedings of the Eighth International Heat Transfer Conference, pp. 2031-2036.

[64] Schneider, C. A., Rasband, W. S., and Eliceiri, K. W., 2012, "NIH Image to ImageJ: 25 years of image analysis," Nature Methods, 9(7), pp. 671-675.

[65] de Gennes, P., Brochard-Wyart, F., and Quéré, D., 2004, "Capillarity and wetting phenomena: drops, bubbles, pearls, waves."

[66] Freeman, R., Houck, A. C., and Kim, C. J., 2015, "Visualization of self-limiting electrochemical gas generation to recover underwater superhydrophobicity," Solid-State Sensors, Actuators and Microsystems, 2015 Transducers—2015 18th International Conference on, pp. 1818-1821.

[67] Jones, P. R., Hao, X., Cruz-Chu, E. R., Rykaczewski, K., Nandy, K., Schutzius, T. M., Varanasi, K. K., Megaridis, C. M., Walther, J. H., Koumoutsakos, P., Espinosa, H. D., and Patankar, N. A., 2015, "Sustaining dry surfaces under water," Sci Rep, 5, p. 12311.

[68] Feng, L., Zhang, Y., Xi, J., Zhu, Y., Wang, N., Xia, F., and Jiang, L., 2008, "Petal effect: A superhydrophobic state with high adhesive force," Langmuir, 24(8), pp. 4114-4119.

[69] Barthlott, W., and Neinhuis, C., 1997, "Purity of the sacred lotus, or escape from contamination in biological surfaces," Planta, 202, pp. 1-8.

[70] Rahman, M. M., Olceroglu, E., and McCarthy, M., 2014, "Role of Wickability on the Critical Heat Flux of Structured Superhydrophilic Surfaces," Langmuir, pp. 11225-11234.

[71] Ahn, H. S., Lee, C., Kim, J., and Kim, M. H., 2012, "The effect of capillary wicking action of micro/nano structures on pool boiling critical heat flux," International Journal of Heat and Mass Transfer, 55(1-3), pp. 89-92.

[72] Betz, A. R., Jenkins, J., Kim, C.-J. C., and Attinger, D., 2013, "Boiling heat transfer on superhydrophilic, superhydrophobic, and superbiphilic surfaces," International Journal of Heat and Mass Transfer, 57(2), pp. 733-741.

[73] Rahman, M. M., Ölçeroğlu, E., and McCarthy, M., 2014, "Role of Wickability on the Critical Heat Flux of Structured Superhydrophilic Surfaces," Langmuir, 30(37), pp. 11225-11234.

[74] Wang, X., Sun, T., and Teja, A. S., 2016, "Density, Viscosity, and Thermal Conductivity of Eight Carboxylic Acids from (290.3 to 473.4) K," Journal of Chemical & Engineering Data.

[75] Price, D. M., and Jarratt, M., 2002, "Thermal conductivity of PTFE and PTFE composites," Thermochimica Acta, 392-393, pp. 231-236.

[76] Avloni, J., Florio, L., Henn, A., and Sparavigna, A., 2007, "Thermal electric effects and heat generation in polypyrrole coated PET fabrics," arXiv preprint arXiv: 0706.3697.

[77] Fu, Q., Rama Rao, G. V., Basame, S. B., Keller, D. J., Artyushkova, K., Fulghum, J. E., and López, G. P., 2004, "Reversible Control of Free Energy and Topography of Nanostructured Surfaces," Journal of the American Chemical Society, 126(29), pp. 8904-8905.

[78] Ichimura, K., Oh, S.-K., and Nakagawa, M., 2000, "Light-Driven Motion of Liquids on a Photoresponsive Surface," Science, 288(5471), pp. 1624-1626.

[79] Abdel-Rahman, M., Ilahi, S., Zia, M. F., Alduraibi, M., Debbar, N., Yacoubi, N., and Ilahi, B., 2015, "Temperature coefficient of resistance and thermal conductivity of Vanadium oxide 'Big Mac' sandwich structure," Infrared Physics & Technology, 71, pp. 127-130.

[80] Powell, R. W., Ho, C. Y., and Liley, P. E., 1966, "Thermal conductivity of selected materials," National Institute of Standards and Technology (NIST), Washington D.C.

[81] Xu, Q. F., Liu, Y., Lin, F. J., Mondal, B., and Lyons, A. M., 2013, "Superhydrophobic TiO2-polymer nanocomposite surface with UV-induced reversible wettability and self-cleaning properties," ACS applied materials & interfaces, 5(18), pp. 8915-8924.

[82] Kwak, K., and Kim, C., 2005, "Viscosity and thermal conductivity of copper oxide nanofluid dispersed in ethylene glycol," Korea-Australia Rheology Journal, 17(2), pp. 35-40.

[83] Liu, T. L., and Kim, C. J., 2014, "Turning a surface superrepellent even to completely wetting liquids," Science, 346(6213), pp. 1096-1100.

[84] Lembach, A. N., Tan, H. B., Roisman, I. V., Gambaryan-Roisman, T., Zhang, Y., Tropea, C., and Yarin, A. L., 2010, "Drop impact, spreading, splashing, and penetration into electrospun nanofiber mats," Langmuir, 26(12), pp. 9516-9523.

[85] C. Frankiewicz and D. Attinger, "Texture and wettability of metallic lotus leaves", Nanoscale, vol. 8, pp. 3982-3990, Feb. 11, 2016.

Although the present invention has been described with respect to certain illustrative embodiments, those skilled in the art will appreciate that changes and modifications can be made thereto without departing from the spirit and scope of the invention as set forth in the appended claims.

We claim:

1. A method of forming a biphilic surface on a substrate comprising a metal or metal alloy comprising copper, comprising the steps of forming one or more hydrophilic areas on the substrate surface by chemically reacting one or more surface areas with at least one reactant that forms copper oxide and forming hydrophobic areas on the substrate surface by chemically etching one or more other surface areas with a combination of hydrochloric acid and at least one of hydrogen peroxide and ferric chloride.

2. The method of claim 1 wherein the metal or metal alloy comprises copper or copper alloy.

3. The method of claim 1 wherein the hydrophilic areas comprise at least one of $Cu_2O$ and CuO.

4. The method of claim 1 wherein the hydrophobic areas comprise etched Cu.

5. The method of claim 1 wherein chemical etching produces super-hydrophobic surface areas.

6. A heat exchanger surface having a biphilic surface produced by the method of claim 1.

7. In a method of pool boiling wherein a heat transfer element is placed between a heat source and liquid, the improvement comprising providing a biphilic surface on the heat transfer element in contact with the liquid wherein the biphilic surface is made using the method of claim 1 to comprise at least one chemically treated hydrophilic surface area and at least one chemically treated hydrophobic surface area.

8. The method of claim 1 wherein the reactant is selected from at least one of hydrogen peroxide, alkali hydroxide, and ammonium hydroxide.

9. A functional metallic surface comprising a metal or a metal alloy having a chemically treated surface microstructure that is switchable between a hydrophilic state and a hydrophobic state in a fluid phase change heat transfer process.

10. The functional metallic surface of claim 9 which reversibly changes from a hydrophobic state or a hydrophilic state, or vice versa.

11. The functional metallic surface of claim 9 which comprises copper or a copper alloy.

12. The functional metallic surface of claim 9 comprising pillars on the chemically treated surface microstructure.

13. The functional metallic surface of claim 9 that comprises an etched copper surface.

14. The functional metallic surface of claim 9 that comprises an etched and oxidized copper surface.

15. A biphilic surface comprising copper including a chemically treated surface having a relatively hydrophobic surface area comprising at least one of copper hydroxide and etched copper and a relatively hydrophilic surface area comprising copper oxide.

16. The surface of claim 15 wherein each surface area includes different tiers of surface features.

17. The surface of claim 16 wherein the surface features comprise pillars.

18. A fluid phase change heat transfer device having a phase change heat transfer metallic surface a having a surface microstructure that is switchable between a hydrophilic state and a hydrophobic state in a fluid and a control device to change the heat transfer surface between the hydrophobic state and the hydrophilic state.

19. The device of claim 18 wherein the heat transfer metallic surface comprises copper or a copper alloy.

20. The device of claim 18 wherein the control device comprises a valve to control fluid pressure.

21. The device of claim 18 wherein the control device comprises a heater to control temperature at the heat transfer metallic surface.

22. The device of claim 18 which is a boiler.

23. The device of claim 18 wherein the heat transfer surface comprises an etched copper surface.

24. The device of claim 18 wherein the heat transfer surface comprises an etched and oxidized copper surface.

25. A method of forming a biphilic surface on a substrate comprising a metal or metal alloy comprising copper, comprising the steps of forming one or more hydrophilic areas on the substrate surface by reacting one or more surface areas with at least one reactant that forms copper oxide and forming hydrophobic areas on the substrate surface by reacting one or more other surface areas with ammonium hydroxide to form copper hydroxide.

26. The method of claim 25 wherein the hydrophilic areas are formed using ammonium hydroxide reacted with the one or more surface areas at a first reaction temperature and the hydrophobic areas are formed using ammonium hydroxide reacted with the one or more other surface areas at a different reaction temperature.

27. The method of claim 25 wherein the hydrophilic areas comprise at least one of $Cu_2O$ and CuO.

28. The method of claim 25 wherein the hydrophobic areas comprise $Cu(OH)_2$.

29. The method of claim 25 wherein the reactant is selected from at least one of hydrogen peroxide, alkali hydroxide, and ammonium hydroxide.

30. A heat exchanger surface having a biphilic surface produced by the method of claim 25.

* * * * *